US010891937B2

(12) United States Patent
Kano

(10) Patent No.: US 10,891,937 B2
(45) Date of Patent: Jan. 12, 2021

(54) NOISE CONTROLLER, NOISE CONTROLLING METHOD, AND RECORDING MEDIUM

(71) Applicant: PANASONIC INTELLECTUAL PROPERTY CORPORATION OF AMERICA, Torrance, CA (US)

(72) Inventor: Hiroyuki Kano, Hyogo (JP)

(73) Assignee: PANASONIC INTELLECTUAL PROPERTY CORPORATION OF AMERICA, Torrance, CA (US)

( * ) Notice: Subject to any disclaimer, the term of this patent is extended or adjusted under 35 U.S.C. 154(b) by 0 days.

(21) Appl. No.: 16/658,362

(22) Filed: Oct. 21, 2019

(65) Prior Publication Data

US 2020/0135167 A1 Apr. 30, 2020

(30) Foreign Application Priority Data

Oct. 26, 2018 (JP) ..... 2018-201803
Jul. 18, 2019 (JP) ..... 2019-132433

(51) Int. Cl.
*G10K 11/178* (2006.01)

(52) U.S. Cl.
CPC .. *G10K 11/17881* (2018.01); *G10K 11/17823* (2018.01); *G10K 11/17825* (2018.01); *G10K 11/17854* (2018.01); *G10K 2210/3026* (2013.01); *G10K 2210/3028* (2013.01)

(58) Field of Classification Search
None
See application file for complete search history.

(56) References Cited

U.S. PATENT DOCUMENTS

2009/0060217 A1* 3/2009 Sakamoto ..... G10K 11/178 381/71.4
2010/0208911 A1* 8/2010 Maeda ..... G10K 11/1785 381/73.1
2013/0136270 A1* 5/2013 Sakamoto ..... G10K 11/178 381/71.4

(Continued)

FOREIGN PATENT DOCUMENTS

JP 06-059688 3/1994
JP 2004-020714 1/2004

*Primary Examiner* — Qin Zhu
(74) *Attorney, Agent, or Firm* — Greenblum & Bernstein, P.L.C.

(57) ABSTRACT

A noise controller includes: a noise detector; a control filter that performs signal processing on a noise signal using a control factor; a speaker that reproduces an output signal from the control filter; an error microphone that detects a residual noise at a control point; a transmission characteristics correction filter that performs signal processing on the noise signal, using characteristics of sound transmission from the speaker to the error microphone; a factor updater that updates the control factor; a correction filter that performs signal processing on an output signal from the control filter, using the characteristics of sound transmission; a subtractor that subtracts, from an error signal indicative of the residue noise, an output signal from the correction filter; and an effect measuring unit that measures a noise reduction effect at the control point based on a difference between an output signal from the subtractor and the error signal.

19 Claims, 21 Drawing Sheets

(56) References Cited

U.S. PATENT DOCUMENTS

| | | | | |
|---|---|---|---|---|
| 2015/0356966 | A1* | 12/2015 | Yano | G10K 11/17881 381/71.8 |
| 2017/0294180 | A1* | 10/2017 | Hiraga | B60R 11/02 |
| 2019/0130890 | A1* | 5/2019 | Tani | G10K 11/17825 |
| 2020/0005760 | A1* | 1/2020 | Tao | G10K 11/17854 |

* cited by examiner

NOISE CONTROLLER, NOISE CONTROLLING METHOD, AND RECORDING MEDIUM

FIELD OF THE INVENTION

The present disclosure relates to a noise controller that reduces noises, a noise controlling method, and a recording medium.

BACKGROUND ART

Conventionally, a technique for reproducing, with a speaker, a control sound reverse in phase to a noise to cancel out the noise is known. Japanese Unexamined Patent Application Publication No. 2004-20714 proposes a technique by which a control sound reproduced by a speaker is controlled based on an engine sound to minimize a noise collected by an error microphone disposed inside a car and, consequently, a noise that propagates from the engine to the car interior is reduced.

When such conventional techniques are applied to a space where many occupants are present, such as a space inside an airplane, multipoint control, by which noises are reduced at locations where the respective occupants are present, is necessary. For example, Japanese Unexamined Patent Application Publication No. 6-59688 proposes a technique by which, to reduce noises generated by a running car (road noises) and propagated to the car interior, a suspension near tires is provided with a plurality of sensors and control sounds reproduced by a plurality of speakers are controlled based on sounds detected by the sensors, to minimize sounds collected respectively by a plurality of error microphones arranged inside the car.

However, a case may be assumed where, for example, a driver, who meets a request from other occupants, increases the volume of a sound reproduced by a car audio and a noise that does not need to be reduced (hereinafter "noise-not-to-be-reduced") is created as a consequence. In such a case, according to the above conventional technique, the error microphone collects noises including not only the noise to be reduced but also the noise-not-to-be-reduced. As a result, the control sound is controlled to minimize noises including the noise-not-to-be-reduced. This makes it impossible to accurately reduce only the noise to be reduced.

SUMMARY OF THE INVENTION

The present disclosure has been made to solve the above problem, and it is therefore an object of the present disclosure to provide a noise controller capable of accurately obtaining a noise reduction effect of reducing a noise to be reduced at a control point, without being affected by a noise-not-to-be-reduced.

A noise controller according to one aspect of the present disclosure includes: a noise detector that detects a noise generated by a noise source; a control filter that performs signal processing on a noise signal indicative of the noise detected by the noise detector, using a predetermined control factor; a speaker that reproduces an output signal from the control filter, as a control sound; an error microphone that is disposed at a control point where interference between the noise propagated from the noise source and the control sound reproduced by the speaker occurs, and detects a residual noise that is left at the control point as a result of the interference; a transmission characteristics correction filter that performs signal processing on the noise signal, using characteristics of sound transmission from the speaker to the error microphone; a factor updater that updates the control factor to minimize an error signal, using the error signal indicative of the residual noise detected by the error microphone and an output signal from the transmission characteristics correction filter; a correction filter that performs signal processing on an output signal from the control filter, using the characteristics of sound transmission from the speaker to the error microphone; a subtractor that subtracts, from the error signal, an output signal from the correction filter; and an effect measuring unit that processes an output signal from the subtractor as a control-off signal representing a noise not yet subjected to control by the interference and processes the error signal as a control-on signal representing a noise having been subjected to control by the interference, and measures a noise reduction effect at the control point based on a difference between the control-off signal and the control-on signal.

DESCRIPTION OF EMBODIMENTS

[Knowledge on which the Present Disclosure is Based]

Conventionally, a technique for reproducing, with a speaker, a control sound reverse in phase to a noise to cancel out the noise. This technique is already put into practical use and is applied to headphones and inner ear headphones (hereinafter "earphone"). The headphones and earphones are generally known as noise-cancelling headphones. The headphones or earphones are attached to the ears. When the above conventional technique is applied to the headphones or earphones, the technique allows the headphones or earphones to control a noise propagating into tiny spaces inside the ears that are enclosed with the headphones or earphones.

Meanwhile, a case is assumed where the above conventional technique is applied to a space in which several occupants are present, such as a space inside a car or airplane. In this case, multipoint control, by which noises are reduced at locations where the respective occupants are present, needs to be carried out. This makes a control process complicated, thus making practical application of the conventional technique difficult. Particularly, applying the conventional technique to a large space in which many occupants are present, such as a space inside an airplane, is difficult.

Figure 14:
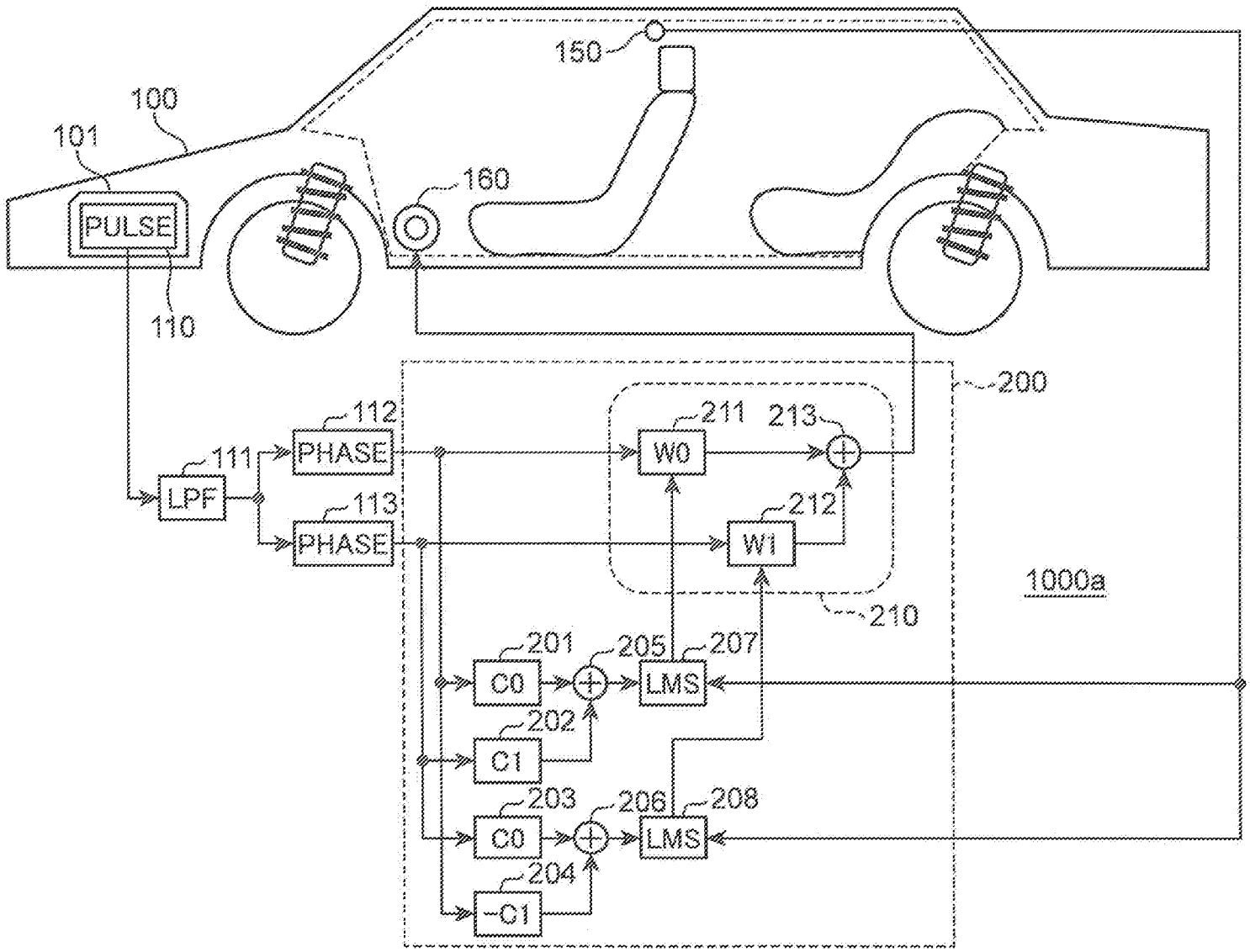
FIG. 14 is a configuration diagram of a conventional noise controller for reducing an engine sound of a car.

In recent years, a simplified noise control used exclusively for cancelling an engine sound of a car has been put into practical use. FIG. 14 is a configuration diagram of a conventional noise controller 1000*a* for reducing an engine sound of a car 100. For example, according to the noise controller 1000*a*, when an engine 101 of the car 100 is running, a tacho pulse generator 110 outputs a pulse signal synchronizing with the number of revolutions of the engine 101, as shown in FIG. 14. This pulse signal is converted by a low-pass filter (hereinafter "LPF") 111 into a cosine wave with a frequency equal to a predetermined frequency that constitutes a noise inside the car and thus poses a problem. The cosine wave output from the LPF 111 is input to a first phase shifter 112 and a second phase shifter 113.

The first phase shifter 112 is set such that its phase advances by $\pi/2$ (rad) relative to a phase of the second phase shifter 113. An output signal from the first phase shifter 112 is, therefore, a cosine wave signal with a frequency equal to a frequency of noise (hereinafter "reference cosine wave signal"). On the other hand, an output signal from the second phase shifter 113 is a sine wave signal with the frequency equal to the frequency of noise (hereinafter "reference sine wave signal"). The reference cosine wave signal and the reference sine wave signal are converted into digital signals, and then are input to a microcomputer 200.

The reference cosine wave signal, which is input to the microcomputer 200, is multiplied by a filter factor W0 at a factor multiplier 211 of an adaptation notch filter 210. The reference sine wave signal, which is input to the microcomputer 200, is multiplied by a filter factor W1 at a factor multiplier 212 of the adaptation notch filter 210. An adder 213 adds up an output signal from the factor multiplier 211 and an output signal from the factor multiplier 212, and then a resultant signal from the adder 213 is reproduced by a speaker 160 as a control sound.

The control sound reproduced by the speaker 160 interferes with a noise propagating from the engine, at a control point where an error microphone 150 is disposed. As a result, the noise is reduced at the control point. At this time, a noise that has not been canceled off and is left at the control point (hereinafter "residual noise") is detected by the error microphone 150 as an error signal. The error signal detected by the error microphone 150 is input to two least mean square (LMS) processing units 207 and 208.

A transmission element 201 convolutes a factor imitating characteristics C0 of sound transmission from the speaker 160 to the error microphone 150, in the reference cosine wave signal output from the first phase shifter 112. A transmission element 202 convolutes a factor imitating characteristics C1 of sound transmission from the speaker 160 to the error microphone 150, in the reference sine wave signal output from the second phase shifter 113. A transmission element 203 convolutes a factor imitating the characteristics C0 of sound transmission from the speaker 160 to the error microphone 150, in the reference sine wave signal output from the second phase shifter 113. A transmission element 204 convolutes a factor imitating characteristics −C1 of sound transmission, reverse to the characteristics C1 of sound transmission from the speaker 160 to the error microphone 150, in the reference cosine wave signal output from the first phase shifter 112.

An output signal from the transmission element 201 and an output signal from the transmission element 202 are added up by an adder 205, and then a resulting signal is input to the LMS processing unit 207. An output signal from the transmission element 203 and an output signal from the transmission element 204 are added up by an adder 206, and then a resulting signal is input to the LMS processing unit 208.

The LMS processing unit 207 calculates the filter factor W0 used by the factor multiplier 211, using a known factor updating algorithm, such as an LMS (Least Mean Square) algorithm (least squares method), to minimize an incoming error signal from the error microphone 150. In the same manner, the LMS processing unit 208 calculates the filter factor W1 used by the factor multiplier 212, to minimize the incoming error signal from the error microphone 150.

In this manner, the filter factors W0 and W1 used by the factor multipliers 211 and 212 of the adaptation notch filter 210 are updated recursively to minimize the incoming error signal from the error microphone 150, and, consequently, are converged to optimum values. In other words, the filter factors W0 and W1 are updated recursively to minimize a noise propagating from the engine at the location where the error microphone 150 is disposed, and, consequently, are converged to the optimum values.

In this manner, the conventional noise controller 1000*a* shown in. FIG. 14 can reduce the noise propagating from the engine at the control point at which the error microphone 150 is disposed, by using the inexpensive microcomputer 200, without using an expensive digital signal processor (DSP).

However, according to the noise controller 1000*a*, because the cosine wave signal and sine wave signal based on the noise generated by the engine are used as signals reference d at the adaptation notch filter 210, a noise propagating from a noise source other than the engine cannot be reduced.

For this reason, a plurality of sensors issued when traveling noises (road noises) of a car, which include an engine sound, are reduced.

Figure 15A:
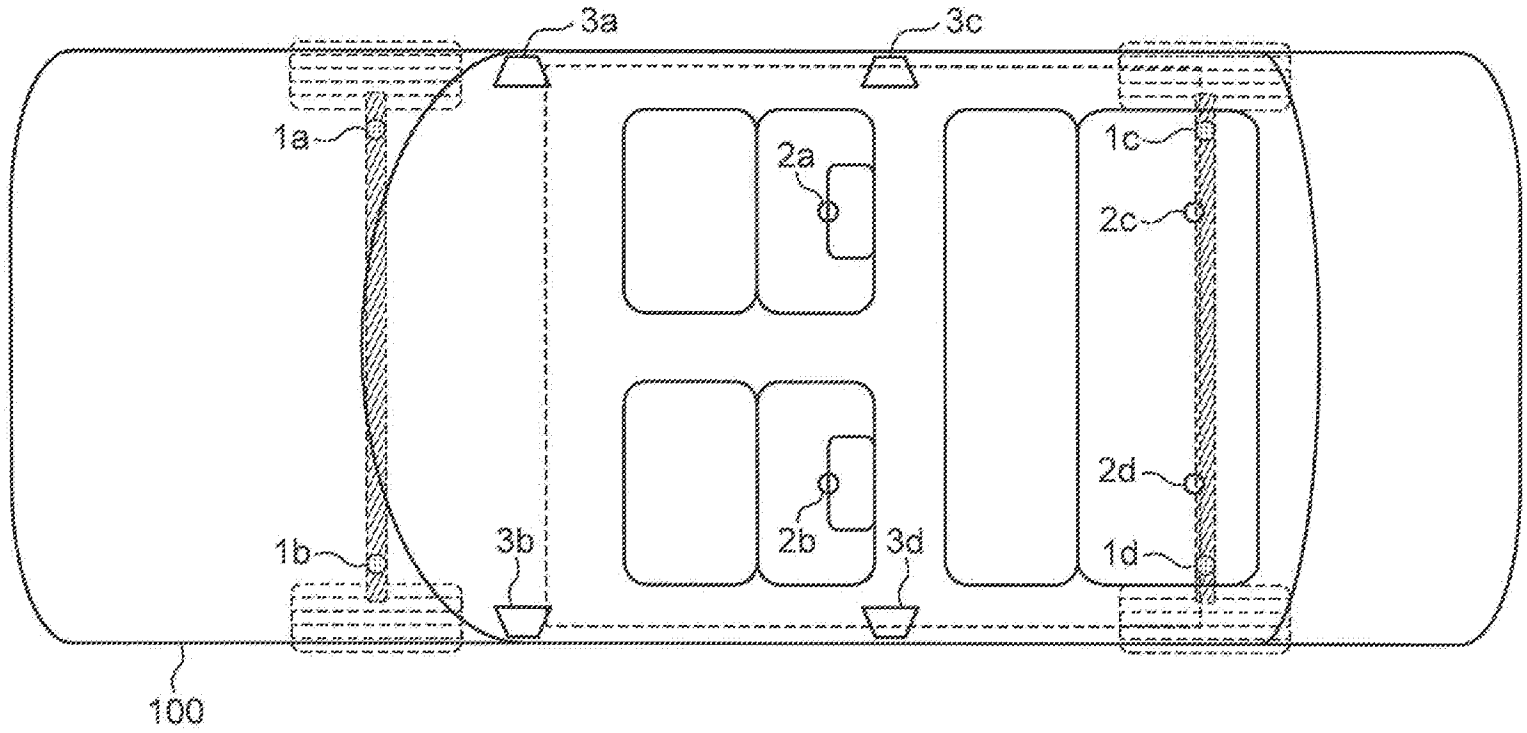
FIG. 15A is a plan view of a configuration of a interior of a car in which the conventional noise controller for reducing road noises is disposed.
Figure 15B:
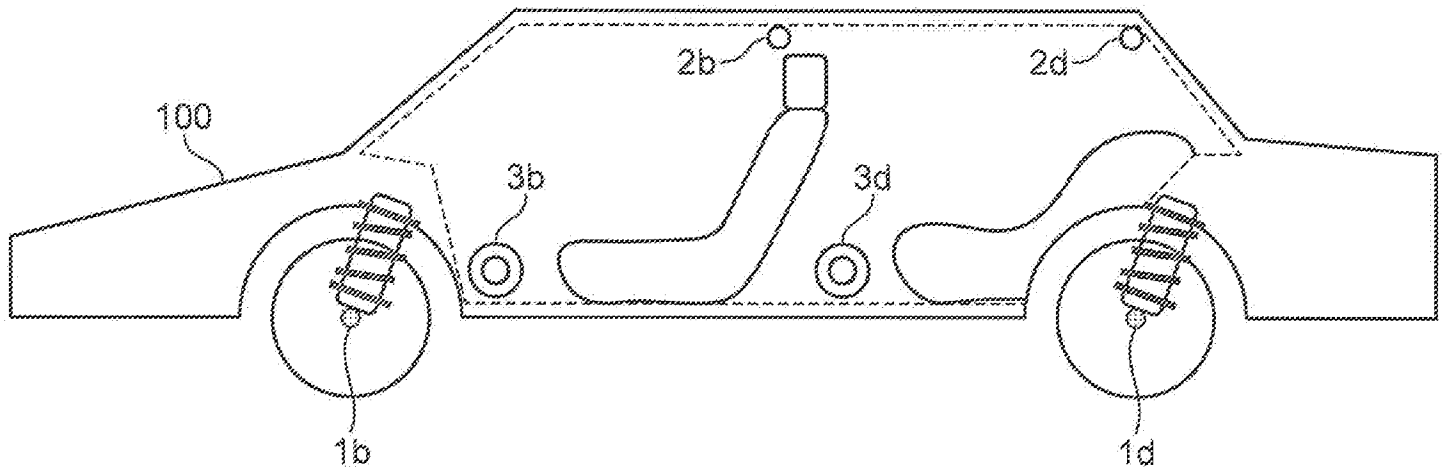
FIG. 15B is a side view of the configuration of the interior car in which the conventional noise controller for reducing road noises is disposed.
Figure 16:
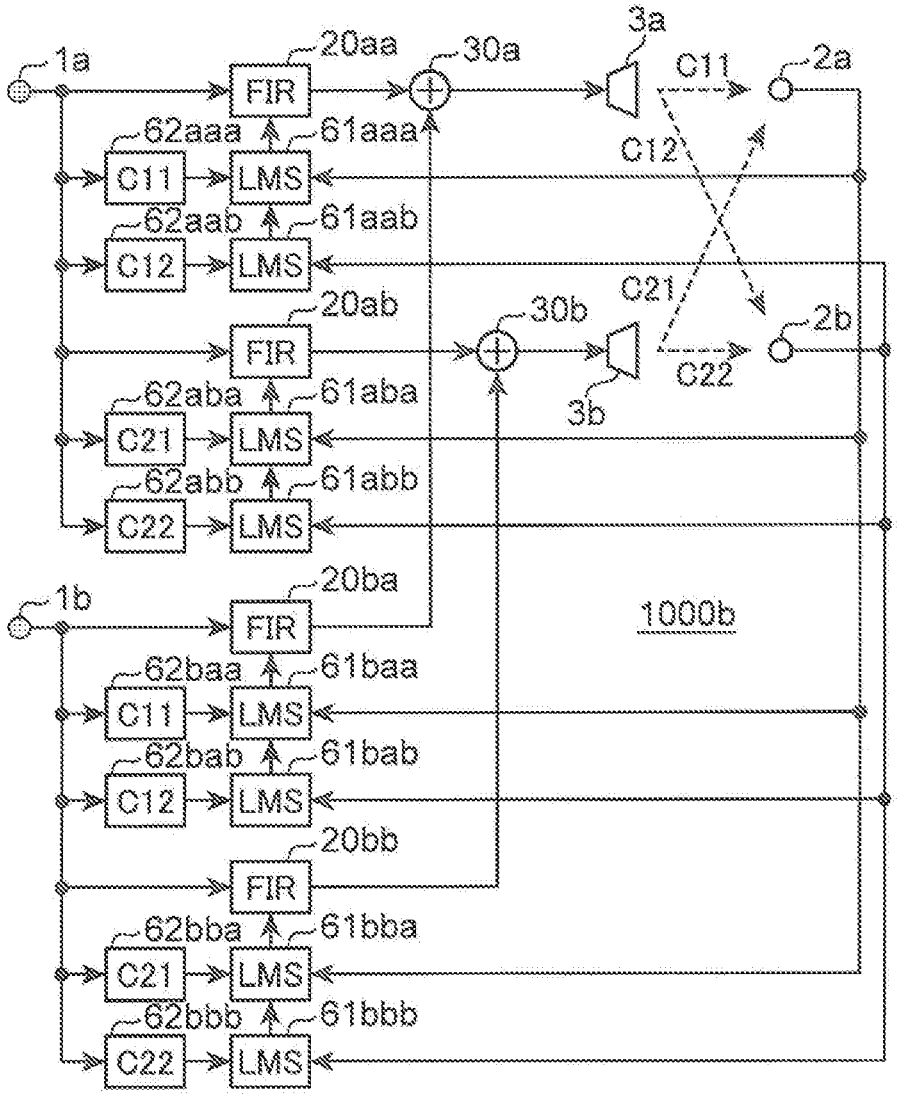
FIG. 16 is a configuration diagram of the conventional noise controller for reducing road noises.

FIG. 15A is a plan view of a configuration of the interior of the car 100 in which a conventional noise controller 1000*b* for reducing road noises is disposed. FIG. 15B is a side view of the configuration of the interior of the car 100 in which the conventional noise controller 1000*b* for reducing road noises is disposed. FIG. 16 is a configuration diagram of the conventional noise controller 1000*b* for reducing road noises.

As shown in FIGS. 15A and 15B, four sensors (noise detectors) 1*a*, 1*b*, 1*c*, and 1*d* are arranged on a suspension near tires of the car 100, and detect road noises created by the suspension (noise source). Specifically, each of the sensors 1*a*, 1*b*, 1*c*, and 1*d* detects vibrations of the suspension during traveling of the car 100, as a road noise.

As shown in FIG. 16, vibration signals detected by the sensors 1*a*, 1*b*, 1*c*, and 1*d* are respectively input to control filters 20*aa*, 20*ab*, 20*ba*, and 20*bb*. For convenience of explanation, FIG. 16 depicts two sensors 1*a* and 1*b*, two speakers 3*a* and 3*b*, and two error microphones 2*a* and 2*b*, which are incorporated in the front half part of the car 100.

However, the noise controller 1000*b* actually further includes two sensors 1*c* and 1*d*, two speakers 3*c* and 3*d*, and two error microphones 2*b* and 2*c*, which are incorporated in the rear half part of the car 100. The noise controller 1000*b* thus performs the same control for reducing road noises both at the front half part and the rear half part of the car 100. In the following description, control for reducing road noises, which is performed by the noise controller 1000*b* of FIG. 16 at the front half part of the car 100, will be explained in detail.

As shown in FIG. 16, when performing control for reducing road noises at the front half part of the car 100, the noise controller 1000*b* uses four control filters 20*aa*, 20*ab*, 20*ba*, and 20*bb*, two sensors 1*a* and 1*b*, two adders 30*a* and 30*b*, two speakers 3*a* and 3*b*, two (one or more) error microphones 2*a* and 2*b*, eight LMS processing units (factor updaters) 61*aaa*, 61*aab*, 61*aba*, 61*abb*, 61*baa*, 61*bab*, 61*bba*, and 61*bbb*, and eight transmission characteristics correction filters 62*aaa*, 62*aab*, 62*aba*, 62*abb*, 62*baa*, 62*bab*, 62*bba*, and 62*bbb*.

The noise controller 1000*b* includes a microcomputer (computer) (not depicted) having a CPU, a memory such as RAM and ROM, and the like. The control filters 20*aa*, 20*ab*, 20*ba*, and 20*bb*, the adders 30*a* and 30*b*, the LMS processing units 61*aaa*, 61*aab*, 61*aba*, 61*abb*, 61*baa*, 61*bab*, 61*bba*, and 61*bbb*, and the transmission characteristics correction filters 62*aaa*, 62*aab*, 62*aba*, 62*abb*, 62*baa*, 62*bab*, 62*bba*, and 62*bbb* are provided as a result of execution, by the CPU, of the program stored in advance in the ROM.

The two control filters 20*aa* and 20*ab* each perform a convolution process (signal processing, first signal processing) on a vibration signal (noise signal) indicative of vibrations detected by the sensor 1*a*, using a predetermined control factor. The two control filters 20*ba* and 20*bb* each perform a convolution process on a vibration signal indicative of vibrations detected by the sensor 1*b*, using a predetermined control factor.

The adder 30*a* adds up an output signal from the control filter 20*aa* and an output signal from the control filter 20*ba*, and outputs a resulting signal to the speaker 3*a*. The adder 30*b* adds up an output signal from the control filter 20*ab* and an output signal from the control filter 20*bb*, and outputs a resulting signal to the speaker 3*b*.

The speaker 3*a* reproduces the signal resulting from the adder 30*a* adding up the output signal from the control filter 20*aa* and the output signal from the control filter 20*ba*, as a control sound. The speaker 3*b* reproduces the signal resulting from the adder 30*b* adding up the output signal from the control filter 20*ab* and the output signal from the control filter 20*bb*, as a control sound.

The two error microphones 2*a* and 2*b* are disposed in an area where interference between a road noise propagating from the suspension to the car interior and the control sounds reproduced by the speakers 3*a* and 3*b* occurs. The two error microphones 2*a* and 2*b* detect residual noises that arc left at the control points, i.e., the locations where the error microphones 2*a* and 2*b* are disposed, as a result of the interference.

The error microphone 2*a* outputs an error signal indicative of the detected residual noise, to the four LMS processing units 61*aaa*, 61*aba*, 61*baa*, and 61*bba*. The error microphone 2*b* outputs an error signal indicative of the detected residual noise, to the four LMS processing units 61*aab*, 61*abb*, 61*bab*, and 61*bbb*. Meanwhile, the sensor 1*a* outputs the vibration signal indicative of detected vibrations to the four transmission characteristics correction filters 62*aaa*, 62*aab*, 62*aba*, and 62*abb*.

The transmission characteristics correction filter 62*aaa* performs a convolution process (signal processing or second signal processing) on the incoming vibration signal from the sensor 1*a*, using a factor approximate to characteristics C11 of sound transmission from the speaker 3*a* to the error microphone 2*a*, and outputs the signal resulting from the convolution process to the LMS processing unit 61*aaa*. The transmission characteristics correction filter 62*aab* performs a convolution process on the incoming vibration signal from the sensor 1*a*, using a factor approximate to characteristics C12 of sound transmission from the speaker 3*a* to the error microphone 2*b*, and outputs the signal resulting from the convolution process to the LMS processing unit 61*aab*. In the same manner, the transmission characteristics correction filters 62*aba* and 62*abb* perform a convolution process on the incoming vibration signals from the sensor 1*a*, respectively, using factors approximate to characteristics C21 of sound transmission from the speaker 3*a* to the error microphone 2*a* and to characteristics C22 of sound transmission from the speaker 3*a* to the error microphone 2*b*, and output the signals resulting from the convolution process to the LMS processing units 61*aba* and 61*abb*, respectively.

The LMS processing unit 61*aaa* executes an LMS algorithm, using the incoming signal from the transmission characteristics correction filter 62*aaa* and the incoming error signal from the error microphone 2*a*, thereby updates a control factor of the control filter 20*aa* to minimize the incoming error signal from the error microphone 2*a*. The LMS processing unit 61*aab* executes an LMS algorithm, using the incoming signal from the transmission characteristics correction filter 62*aab* and the incoming error signal from the error microphone 2*b*, thereby updates a control factor of the control filter 20*aa* to minimize the incoming error signal from the error microphone 2*b*.

In the same manner, the LMS processing units 61*aba* and 61*abb* execute their respective LMS algorithms, using the incoming signals from the transmission characteristics correction filters 62*aba* and 62*abb* and the incoming error signals from the error microphones 2*a* and 2*b*, respectively. The LMS processing units 61*aba* and 61*abb* thus update a control factor of the control filter 20*ab* to minimize the incoming error signals from the error microphones 2*a* and 2*b*, respectively.

In the same manner, the sensor 1*b* outputs the vibration signal indicative of detected vibrations to the four transmission characteristics correction filters 62*baa*, 62*bab*, 62*bba*, and 62*bbb*. The transmission characteristics correction filters 62*baa* and 62*bab* perform a convolution process on the incoming vibration signal from the sensor 1*b*, respectively, using factors approximate to the characteristics C11 of sound transmission from the speaker 3*a* to the error microphone 2*a* and to the characteristics C12 of sound transmission from the speaker 3*a* to the error microphone 2*b*, and output the signals resulting from the convolution process to the LMS processing units 61*baa* and 61*bab*, respectively. The transmission characteristics correction filters 62*bba* and 62*bbb* perform a convolution process on the incoming vibration signal from the sensor 1*b*, respectively, using factors approximate to the characteristics C21 of sound transmission from the speaker 3*b* to the error microphone 2*a* and to the characteristics C22 of sound transmission from the speaker 3*b* to the error microphone 2*b*, and output the signals resulting from the convolution process to the LMS processing units 61*bba* and 61*bbb*, respectively.

The LMS processing units 61*baa* and 61*bab* execute their respective LMS algorithms, using the incoming signals from the transmission characteristics correction filters 62*baa* and 62*bab* and the incoming error signals from the error microphones 2*a* and 2*b*, respectively. The LMS processing units 61*baa* and 61*bab* thus update a control factor of the control filter 20*ba* to minimize the incoming error signals from the error microphones 2*a* and 2*b*, respectively. In the same manner, the LMS processing units 61*bba* and 61*bbb* execute their respective LMS algorithms, using the incoming signals from the transmission characteristics correction fillers 62*bba* and 62*bbb* and the incoming error signals from the error microphones 2*a* and 2*b*, respectively. The LMS processing units 61*bba* and 61*bbb* thus update a control factor of the control filter 20*bb* to minimize the incoming error signals from the error microphones 2*a* and 2*b*, respectively.

Finally, through the above processes, road noises in the form of the vibration signals indicative of vibrations detected by the sensors 1*a*, 1*b*, 1*c*, and 1*d* and control sounds reproduced by the speakers 3*a*, 3*b*, 3*c*, and 3*d* interfere with each other at control points, i.e., locations where the error microphones 2*a*, 2*b*, 2*c*, and 2*d* are disposed. This reduces the road noises.

In general, a driver who is driving the car changes the rate of opening of the throttle in accordance with a traveling status of the car, and thereby adjusts the speed and the engine rotating speed of the car depending on situations. When the car is traveling, therefore, the frequency and level of an engine sound fluctuates frequently. For this reason, control for reducing the engine sound needs to include a process of constantly adapting control sounds reproduced by the speakers to a traveling status. In other words, even if the frequency of the engine sound (engine rotating speed) has converged once, the above-described operation of updating the control factors (hereinafter "adaptation operation") needs to be continued. In this manner, control for reducing the engine sound just requires the continuous adaptation operation for control over the engine sound. This control is simple and takes less cost.

Road noises, however, originate from a plurality of noise sources to have a strong tendency of randomness and have a wide frequency band. For this reason, in control for reducing road noises, control factors with a longer tap length are adopted, and a plurality of sensors that detect noises from the noise sources are provided. In a plurality of locations inside the car, a plurality of speakers and of error microphones are provided and the adaptation operations are continued, respectively, to properly reduce road noises. In this case, each control factor is updated continuously to minimize a residual noise collected by each error microphone. This process reduces a road noise at each control point, i.e., the location where each error microphone is disposed.

As mentioned above, road noises in general tend to be highly random and have a wide frequency band. For this reason, for example, the control factors of the control filters 20*aa* and 20*ab* shown in FIG. 16 converge in accordance with sound transmission characteristics at the time of transmission of road noises from the suspension near the sensor 1*a* to the error microphones 2*a* and 2*b*. This means that when road noises are reduced, if the control factors converge to control factor values that are in accordance with the sound transmission characteristics, a specific noise reduction effect can be maintained without continuing the adaptation operation.

Specifically, a case is assumed where in a certain traveling status which, for example, the car is traveling at 60 km/h), a control factor converges to a control factor value with which a road noise with a frequency ranging from 100 Hz to 500 Hz is reduced by 10 dB. In this case, by using this control factor, the road noise with the frequency ranging from 100 Hz to 500 Hz can be reduced by 10 dB even in another traveling status (in which, e.g., the car is traveling at 100 km/h).

In this manner, differently from control for reducing the engine sound, control for reducing road noises offers a certain noise reduction effect even if the control factor is fixed, regardless of changes in the traveling speed of the car (or in the engine rotating speed). This leads to a concept that when the noise controller 1000*b* is applied to the car to reduce its road noises, an initial value for the control factor is determined and the control factor is fixed to that initial value. A specific example of a method for determining such an initial value for the control factor will hereinafter be described.

It is impossible for a car manufacturer to know in advance a traveling status of a car, such as in what place the user drives the car, how many occupants, not including the driver, the car carries, or whether the driver drives the car while replaying music, etc., on an audio. For example, even if the car manufacturer manages to determine a traveling position of the car based on information stored in a navigation system, the manufacturer cannot exactly know or determine the condition of the road surface on which the car is traveling. For example, it is difficult for the manufacturer to exactly know or determine that the road surface on which the car is traveling is not a smooth asphalted surface, such as a surface with lots of irregularities, an uneven surface with manholes, or the like.

It is also difficult to exactly know or determine that the road surface on which the car is traveling is a newly asphalted flat surface quickly created out of an irregular surface by road construction work, which is-ended a moment ago. It is also difficult to exactly know or determine that the road surface on which the car is traveling is a surface soaked with rainwater or melting snow or a surface with no dry part. Furthermore, when a main lane and a passing lane have different surface conditions, it is difficult to exactly know or determine which lane the car is traveling or whether the car is switching; the lane.

Thus, the car manufacturer usually lets the car travel a test course whose surface condition is kept constant. The car manufacturer causes the car to travel under a specific condition, such as traveling at 60 km/h with the car audio replaying nothing, and then determines a control factor under such a condition. The car manufacturer then fixes the control factor to the determined control factor, and measures an average road noise per a fixed period (e.g., 10 seconds) when the car is traveling a predetermined effect measurement section (e.g., a straight section of the test course).

Figure 17:
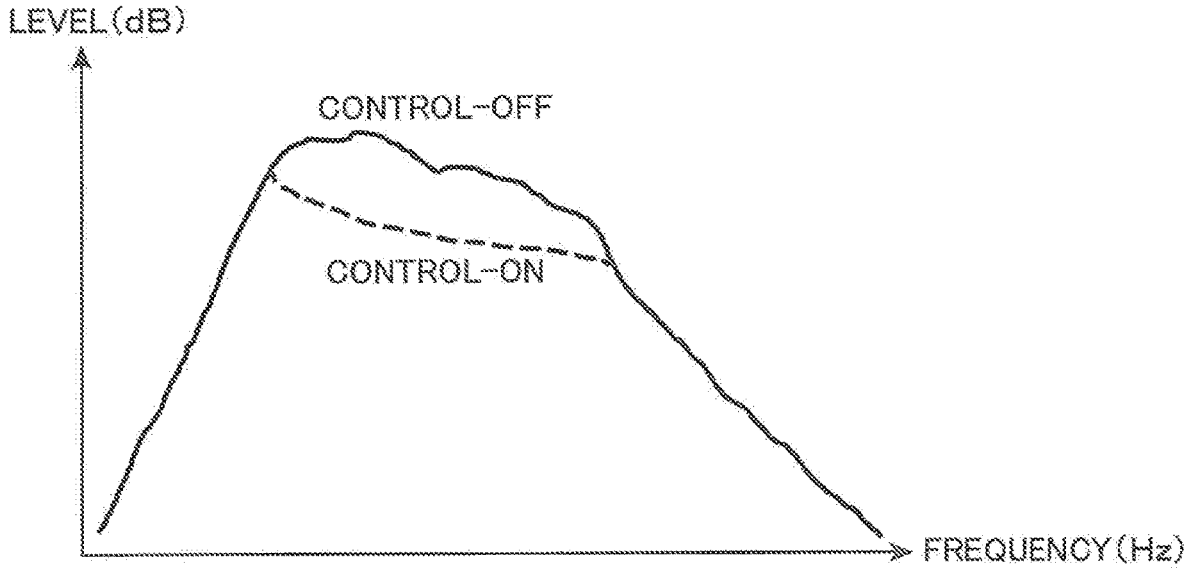
FIG. 17 is a diagram illustrating an effect of road noise control by the conventional noise controller.

FIG. 17 is a diagram illustrating an effect of road noise control by the conventional noise controller 1000*b*. The car manufacturer, for example, derives control-off characteristics indicating a relationship between the frequency of the measured road noise and the level (sound pressure) of the measured road noise, as drawn by a continuous line in FIG. 17. Specifically, the average road noise per a fixed period (e.g., 10 seconds) when the car is traveling the effect measurement section is measured as the noise controller 1000*b* is prohibited from carrying out the above adaptation operation. The car manufacturer then allows the noise controller 1000*b* to carry out the adaptation operation in another test run, in which the manufacturer measures the average road noise per a fixed period (e.g., 10 seconds) when the car is traveling the effect measurement section as the noise controller 1000*b* carries out the adaptation operation. The car manufacturer thus derives control-on characteristics indicating a relationship between the frequency of the measured road noise and the level of the measured road noise, as shown by a broken line in FIG. 17.

The car manufacturer then calculates a difference in sound level at each frequency between the control-off characteristics and control-on characteristics, and checks whether a road noise reduction effect indicated by the difference has reached a predetermined target value. Through these processes, the car manufacturer determines whether the control factor has converged. When the road noise reduction effect indicated by tile difference fails to reach the predetermined target value, the car manufacturer determines that the control factor has not converged. In this case, the car manufacturer causes the car to travel the effect measurement section again as the noise controller 1000*b* is caused to carry out the adaptation operation, and derives control-on characteristics again in the same manner as described above. The car manufacturer repeats this process until the noise reduction effect reaches the predetermined target value.

Afterward, when the noise reduction effect has reached the predetermined target value, the car manufacturer determines that the control factor has converged, and therefore determines that a fixed control value can be used thereafter. The car manufacturer then defines the control factor having converged to be an initial value for the control factor and stores the initial value in the ROM in advance.

According to this method, however, the car manufacturer has to design control factors for many cars one by one. This is extremely troublesome in a case where a large quantity of cars are put on sale. A case is assumed where an initial value for the control factor determined by using one car is defined as a representative value and this representative value is specified as an initial value for the control factor for other cars. In this case, because road noise transmission characteristics of all cars do not always match, obtaining a desired noise reduction effect is not a guaranteed fact.

It should be noted, in particular, that the speaker is under product control on the assumption that it has an output characteristics variation ranging from approximately 10% to 20%. It is also assumed that the output characteristics of the speaker vary further when the speaker is incorporated in the car. It is also assumed that the characteristics of a microphone, a micro-amplifier, a power amplifier, and the like incorporated in a circuit vary as well. For these reasons, when an initial value for the control factor determined by using one car is defined as a representative value and the representative value is specified as an initial value for the control factor for other cars, it is not guaranteed that a road noise reduction effect reaches a desired target value in all cars. In an undesirable case, the noise controller 1000*b* may start oscillating.

These concerns lead to an idea that the user who have purchased the car is allowed to set an initial value for the control factor. However, it is difficult for the user to derive a difference between the control-off characteristics and the control-on characteristics under a stable traveling condition, such as the above test course prepared by the car manufacturer. Therefore, it is difficult for the user to determine a proper initial value for the control factor.

Considering the above, the inventors have concluded that continuously reducing road noises while fixing the control factor to a certain value is difficult. The inventors have then studied that when a desired noise reduction effect cannot be obtained during a control factor fixing operation, the adaptation operation is carried out, and then when the desired noise reduction effect can be obtained, the control factor is fixed to a control factor in the current situation and the control factor fixing operation is resumed.

However, a case may be assumed where, for example, a driver, who meets a request from other occupants, increases the volume of a sound reproduced by a car audio and a noise that does not need to be reduced (hereinafter "noise-not-to-be-reduced") is created as a consequence. In such a case, according to the above conventional technique, the error microphone collects noises including not only the noise to be reduced but also the noise-not-to-be-reduced.

As a result, the control sound is controlled to minimize noises including the noise-not-to-be-reduced. This makes it impossible to accurately reduce only the noise-to-be-reduced. In other words, according to the conventional technique, an effect of reducing the noise-to-be-reduced cannot be obtained accurately. Thus, the inventors have diligently studied how to accurately obtain the effect of reducing the noise-to-be-reduced, and have consequently conceived the present disclosure.

An embodiment according to the present disclosure provides a noise controller including: a noise detector that detects a noise generated by a noise source; a control filter that performs signal processing on a noise signal indicative of the noise detected by the noise detector, using a predetermined control factor; a speaker that reproduces an output signal from the control filter, as a control sound; an error microphone that is disposed at a control point where interference between the noise propagated from the noise source and the control sound reproduced by the speaker occurs, and detects a residual noise that is left at the control point as a result of the interference; a transmission characteristics correction filter that performs signal processing on the noise signal, using characteristics of sound transmission from the speaker to the error microphone; a factor updater that updates the control factor to minimize an error signal, using the error signal indicative of the residual noise detected by the error microphone and an output signal from the transmission characteristics correction filter; a correction filter that performs signal processing on an output signal from the control filter, using the characteristics of sound transmission from the speaker to the error microphone; a subtractor that subtracts, from the error signal, an output signal from the correction filter; and an effect measuring unit that processes an output signal from the subtractor as a control-off signal representing a noise not yet subjected to control by the interference and processes the error signal as a control-on signal representing a noise having been subjected to control by the interference, and measures a noise reduction effect at the control point based on a difference between the control-off signal and the control-on signal.

An embodiment according to the present disclosure provides a noise control method performed by a computer of a noise controller, the noise control method including: detecting a noise generated by a noise source, using a sensor; performing first signal processing on a noise signal indicative of the noise detected by the sensor, using a predetermined control factor; causing a speaker to reproduce a signal resulting from the first signal processing, as a control sound; detecting a residual noise that is left at a control point as a result of interference, using an error microphone disposed at the control point where the interference between the noise propagated from the noise source and the control sound reproduced by the speaker occurs; performing second signal processing on the noise signal, using characteristics of sound transmission from the speaker to the error microphone; updating the control factor to minimize an error signal, using the error signal indicative of the residual noise detected by the error microphone and a signal resulting from the second signal processing; performing third signal processing on a signal resulting from the first signal processing, using the characteristics of sound transmission from the speaker to the error microphone; subtracting, from the error signal, a signal resulting from the third signal processing; and processing a signal given by subtraction as a control-off signal representing a noise not yet subjected to control by the interference and processing the error signal as a control-on signal representing a noise having been subjected to control by the interference, and measuring a noise reduction effect at the control point based on a difference between the control-off signal and the control-on signal.

An embodiment according to the present disclosure provides a non-transitory computer-readable recording medium storing therein a program that causes a computer to execute the noise control method.

An embodiment according to the present disclosure provides a noise controller including: a noise detector that detects a noise generated by a noise source; a control filter that performs signal processing on a noise signal indicative of the noise detected by the noise detector, using a predetermined control factor; a speaker that reproduces an output signal from the control filter, as a control sound; an error microphone that is disposed at a control point where interference between the noise propagated, from the noise source and the control sound reproduced by the speaker occurs, and detects a residual noise that is left at the control point as a result of the interference; a correction filter that performs signal processing on an output signal from the control filter, using characteristics of sound transmission from the speaker to the error microphone; a subtractor that subtracts, from the error signal, an output signal from the correction filter; and an effect measuring unit that processes an output signal from the subtractor as a control-off signal representing a noise not yet subjected to control by the interference and processes the error signal as a control-on signal representing a noise having been subjected to control by the interference, and measures a noise reduction effect at the control point based on a difference between the control-off signal and the control-on signal.

According to the above aspect, a signal given by subtracting an output signal from the correction filter, from an error signal indicative of the residual noise detected by the error microphone, is processed as a control-off signal while the error signal is processed as a control-on signal, and a noise reduction effect at the control point is measured based on a difference between the control-off signal and the control-on signal. In other words, the noise reduction effect at the control point is measured based on an output signal from the correction filter, the output signal representing a difference between the signal given by subtracting, from the error signal, the output signal from the correction filter and the error signal.

Even if a sound irrelevant to a noise created by a noise source to be target propagates to the control point and, consequently, the sound irrelevant to the noise created by the noise source is included in the error signal indicative of the residual noise detected by the error microphone, therefore, the effect of reducing the noise propagated from the noise source at the control point can be measured precisely based only on an output signal from the correction filter, the output signal being irrelevant to the sound irrelevant to the noise.

The noise controller according to the above aspect may further include an adaptation enabling state determining unit that determines whether or not to cause the factor updater to update the control factor.

According to this aspect, whether or not to cause the factor updater to update the control factor can be determined. As a result, when updating of the control factor by the factor updater leads to an increase in a noise at the control point, the factor updater is not allowed to update the control factor. Only when updating of the control factor by the factor updater leads to a drop in a noise at the control point, therefore, the factor updater is allowed to update the control factor.

In the above aspect, the factor updater may update the control factor using a predetermined convergence constant. The effect measuring unit may measure a difference between the control-off signal and the control-on signal, as the noise reduction effect and perform a determination process of determining whether the noise reduction effect has achieved a predetermined target value. When determining by the determining process that the noise reduction effect has achieved the predetermined target value, the effect measuring unit may conclude that the control factor has converged to an optimum value, and may stop the factor updater from updating the control factor while fixing the control factor to the optimum value. When determining that the noise reduction effect has not achieved the predetermined target value, the effect measuring unit may conclude that the control factor has not converged to the optimum value, and may create a new convergence constant by adding a predetermined value to the convergence constant used by the factor updater at the time of measurement of the noise reduction effect and cause the factor updater to resume updating of the control factor using the new convergence constant.

According to this aspect, when a difference between the control-off signal and the control-on signal has achieved a predetermined target value to give a conclusion that the control factor has converged to an optimum value, the control factor is fixed to the optimum value to avoid unnecessary control factor updating. When the difference has not achieved the predetermined target value to give a conclusion that the control factor has not converged to the optimum value, on the other hand, the control factor can be updated, using a new convergence constant larger than the convergence constant used at the time of measurement of the noise reduction effect. In this manner, according to this aspect, the control factor can be caused to converge efficiently to the optimum value.

In the above aspect, the effect measuring unit may perform signal processing on the control-off signal and on the control-on signal, using an A characteristics factor indicating A characteristics imitating the human auditory characteristics, and may measure a difference between the control-off signal having been subjected to the signal processing and the control-on signal having been subjected to the signal processing, as the noise reduction effect.

According to the above aspect, the noise reduction effect can be measured as the human auditory characteristics are taken into consideration. As a result, even in a situation where a person at a control point hears a sound irrelevant to a noise created at a noise source to be target, an effect of reducing the noise propagated from the noise source at the control point can be measured precisely without being affected by the sound irrelevant to the noise.

In the above aspect, the effect measuring unit may have a frequency analyzer that calculates the frequency characteristics of the control-off signal and of the control-on signal, and a frequency difference effect calculating unit that, for each frequency making up the frequency characteristics, calculates a first difference representing a difference between the control-off signal and the control-on signal, as an index for the noise reduction effect.

According to this aspect, a first difference representing a difference between the control-off signal and the control-on signal at each frequency making up the frequency characteristics of the control-off signal and the control-on signal can be calculated as an index for the noise reduction effect. As a result, whether the noise reduction effect has achieved a predetermined target value can be determined in accordance with the number of first differences each having achieved a predetermined value corresponding to the target value.

In the above aspect, the effect measuring unit may have a frequency analyzer that calculates the frequency characteristics of the control-off signal and of the control-on signal, an overall calculating unit that calculates an overall value for the control-off signal and an overall value for the control-on signal in the whole frequency bands of the control-off signal and control-on signal, using the frequency characteristics, and an overall value difference effect calculating unit that calculates a second difference representing a difference between the overall value for the control-off signal and the overall value for the control-on signal, as an index for the noise reduction effect.

According to this aspect, a second difference representing a difference between an overall value for the control-off signal and an overall value for the control-on signal, the second difference being calculated using the frequency characteristics of the control-off signal and of the control-on signal, can be calculated as an index for the noise reduction effect. Whether the noise reduction effect has achieved the predetermined target value, therefore, can be determined by determining whether the second difference achieved a predetermined value corresponding to the target value.

In the above aspect, the effect measuring unit may have a frequency analyzer that calculates the frequency characteristics of the control-off signal and of the control-on signal, a frequency difference effect calculating unit that, for each frequency making up the frequency characteristics, calculates a first difference representing a difference between the control-off signal and the control-on signal, as an index for the noise reduction effect, an overall calculating unit that calculates an overall value for the control-off signal and an overall value for the control-on signal in the whole frequency bands of the control-off signal and control-on signal, using the frequency characteristics, and an overall value difference effect calculating unit that calculates a second difference representing a difference between the overall value for the control-off signal and the overall value for the control-on signal, as an index for the noise reduction effect.

According to this aspect, a first difference representing a difference between the control-off signal and the control-on signal at each frequency making up the frequency characteristics of the control-off signal and the control-on signal can be calculated as an index for the noise reduction effect. As a result, whether the noise reduction effect has achieved a predetermined target value can be determined in accordance with the number of the first differences each having achieved a predetermined value corresponding to the target value and so on.

In addition, a second difference representing difference between an overall value for the control-off signal and an overall value for the control-on signal, the second difference being calculated using the frequency characteristics of the control-off signal and of the control-on signal, can be calculated as an index for the noise reduction effect. Whether the noise reduction effect has achieved the predetermined target value, therefore, can be determined also by determining whether the second difference achieved a predetermined value corresponding to the target value and so on.

In the above aspect, the effect measuring unit may further have a band limiting unit that extracts signals with a frequency within a predetermined evaluation target frequency band, respectively, from the control-off signal and from the control-on signal, using the frequency characteristics. The overall calculating unit may calculate an overall value for the signal extracted from the control-off signal and an overall value for the signal extracted from the control-on signal, both signals being extracted by the band limiting unit, in the whole frequency hands of the signals. The overall value difference effect calculating unit may calculate a difference between the overall value for the signal extracted from the control-off signal by the band limiting unit and the overall value for the signal extracted from the control-on signal by the band limiting unit, as the second difference.

According to this aspect, a difference between an overall value for a signal with a frequency within an evaluation target frequency hand, the signal being included in the control-off signal, and an overall value for a signal with a frequency within the evaluation target frequency hand, the signal being included in the control-on signal, is calculated as a second difference. Consequently, even if by a noise-not-to-be-reduced being occured and so on, a signal with a frequency outside the evaluation target frequency band is included in the control-off signal and the control-on signal, therefore, by determining whether the second difference has achieved a predetermined value corresponding to the target value and so on, whether the noise reduction effect has achieved the predetermined target value can be determined precisely as the effect of the signal with the frequency outside the evaluation target frequency band is eliminated.

In the above aspect, the factor updater may update the control factor using a predetermined convergence constant. The effect measuring unit may perform a determination process of determining whether the noise reduction effect has achieved a predetermined target value. When, in the determination process, the first difference at over half of the entire frequencies included in a predetermined evaluation target frequency band has achieved a predetermined first target value corresponding to the target value, the first difference being calculated by the frequency difference effect calculating unit, the effect measuring unit may determine that the noise reduction effect has achieved the target value to conclude that the control factor has converged to an optimum value, and may stop the factor updater from updating the control factor to fix the control factor to the optimum value. When the first difference at over half of the entire frequencies included in the evaluation target frequency band has not achieved the first target value, the first difference being calculated by the frequency difference effect calculating unit, the effect measuring unit may determine that the noise reduction effect has not achieved the target value to conclude that the control factor has not converged to the optimum value, and may create a new convergence constant by adding a predetermined value to the convergence constant used by the factor updater at the time of calculation of the first difference and cause the factor updater to resume updating of the control factor using the new convergence constant.

According to this aspect, whether the noise reduction effect has achieved the target value can be determined precisely, based on a ratio of frequencies for the first difference having achieved a predetermined first target value corresponding to the target value, to the entire frequencies included in a predetermined evaluation target frequency band.

When the noise reduction effect has achieved the predetermined target value to give a conclusion that the control factor has converged to an optimum value, the control factor is fixed to the optimum value to avoid unnecessary control factor updating. When the noise reduction effect has not achieved the predetermined target value to give a conclusion that the control factor has not converged to the optimum value, a new convergence constant larger than the convergence constant used at the time of calculation of the first difference is used to update the control factor. In this manner, according to this aspect, the control factor can be caused to converge efficiently to the optimum value.

In the above aspect, the factor updater may update the control factor using a predetermined convergence constant. The effect measuring unit may perform a determination process of determining whether the noise reduction effect has achieved a predetermined target value. When, in the determination process, the second difference has achieved a predetermined second target value corresponding to the target value, the effect measuring unit may determine that the noise reduction effect has achieved the target value to conclude that the control factor has converged to an optimum value, and may stop the factor updater from updating the control factor while fixing the control factor to the optimum value. When the second difference has not achieved the second target value, the effect measuring unit may determine that the noise reduction effect has not achieved the target value to conclude that the control factor has not converged to the optimum value, and may create a new convergence constant by adding a predetermined value to the convergence constant used by the factor updater at the time of calculation of the second difference and cause the factor updater to resume updating of the control factor using the new convergence constant.

According to this aspect, whether the noise reduction effect has achieved the target value can be determined precisely, depending on whether the second difference has achieved a predetermined second target value corresponding to the target value.

When the noise reduction effect has achieved the predetermined target value to give a conclusion that the control factor has converged to an optimum value, the control factor is fixed to the optimum value to avoid unnecessary control factor updating. When the noise reduction effect has not achieved the predetermined target value to give a conclusion that the control factor has not converged to the optimum value, a new convergence constant larger than the convergence constant used at the time of calculation of the second difference is used to update the control factor. In this manner, according to this aspect, the control factor can be caused to converge efficiently to the optimum value.

In the above aspect, the factor updater may update the control factor using a predetermined convergence constant. The effect measuring unit may perform a determination process of determining whether the noise reduction effect has achieved a predetermined target value. When, in the determination process, the first difference at over half of the entire frequencies included in a predetermined evaluation target frequency band has achieved a predetermined first target value corresponding to the target value, the first difference being calculated by the frequency difference effect calculating unit, and that the second difference has achieved a predetermined second target value corresponding to the target value, the effect measuring unit may determine that the noise reduction effect has achieved the target value to conclude that the control factor has converged to an optimum value, and may stop the factor updater from updating the control factor to fix the control factor to the optimum value. When the first difference at over half of the entire frequencies included in the evaluation target frequency band has not achieved the first target value, the first difference being calculated by the frequency difference effect calculating unit, the effect measuring unit may determine that the noise reduction effect has not achieved the target value to conclude that the control factor has not converged to the optimum value, and may create a new convergence constant by adding a predetermined value to the convergence constant used by the factor updater at the time of calculation of the first difference and cause the factor updater to resume updating of the control factor using the new convergence constant. When the second difference has not achieved the second target value, the effect measuring unit may determine that the noise reduction effect has not achieved the target value to conclude that the control factor has not converged to the optimum value, and may create a new convergence constant by adding a predetermined value to the convergence constant used by the factor updater at the time of calculation of the second difference and cause the factor updater to resume updating of the control factor using the new convergence constant.

According to this aspect, whether the noise reduction effect has achieved the target value can be determined precisely, based on a ratio of frequencies for the first difference having achieved a predetermined first target value corresponding to the target value, to the entire frequencies included in a predetermined evaluation target frequency band. Likewise, whether the noise reduction effect has achieved the target value can be determined precisely, depending on whether the second difference has achieved a predetermined second target value corresponding to the target value.

When the noise reduction effect has achieved the predetermined target value to give a conclusion that the control factor has converged to an optimum value, the control factor is fixed to the optimum value to avoid unnecessary control factor updating. When the noise reduction effect has not achieved the predetermined target value to give a conclusion that the control factor has not converged to the optimum value, a new convergence constant larger than the convergence constant used at the time of calculation of the first difference or the second difference is used to update the control factor. In this manner, according to this aspect, the control factor can be caused to converge efficiently to the optimum value.

In the above aspect, when determining in the determination process that the first difference at a predetermined number or more of frequencies out of frequencies in a predetermined noise increasing hand included in the evaluation target frequency band, the first difference being calculated by the frequency difference effect calculating unit, exceeds a predetermined tolerance set in accordance with the target value, the effect measuring unit may conclude that the a problem with the control factor has occurred and stop the factor updater from updating the control factor.

According to this aspect, whether a problem with the control factor has occurred can be determined precisely, based on a ratio of frequencies corresponding to the first difference exceeding a tolerance set in accordance with the target value, the frequencies in a predetermined noise increasing band included in the predetermined evaluation target frequency band. When it is determined that a problem with the control factor has occurred, updating the control factor by the factor updater can be stopped properly.

In the above aspect, the predetermined number may be "1".

According to this aspect, when even one frequency corresponding to the first difference exceeding the predetermined tolerance set in accordance with the target value is present among frequencies in the predetermined noise increasing band included in the predetermined evaluation target frequency band, it is determined that a problem with the control factor has a occurred, and therefore updating the control factor by the factor updater can be stopped.

In the above aspect, a plurality of the error microphones may be provided, and the effect measuring unit may perform the determination process on each of the error microphones, with a location where each of the error microphones is disposed being defined as the control point and a separate target value set in advance for each of the error microphones being defined as the target value.

According to this aspect, whether a noise reduction effect at each location where each of the error microphones is disposed has achieved a separate target value set in advance for each of the error microphones can be determined separately.

In the above aspect, the separate target values may be predetermined priority orders, respectively, and when determining by the determination process that the noise reduction effect has achieved the target value, the determination process using a separate target value given a highest priority order, as the target value, the effect measuring unit may determine that the noise reduction effect has achieved the target value at every one of the control points at which the determination process is carried out.

According to this aspect, determining whether a noise reduction effect has achieved the separate target value at each of one or more control points is unnecessary. By determining that the noise reduction effect has achieved a separate target value given a highest priority order, it can be simply determined that the noise reduction effect has achieved the separate target value at every control point.

In the above aspect, when a value given by averaging instantaneous value levels of the error signal in a predetermined period is within a predetermined threshold range, the adaption enabling state determining unit may determine that it cause the factor updater to update the control factor.

According to this aspect, even when an instantaneous value level of the error signal instantaneously exceeds the threshold range, if a value given by averaging instantaneous value levels of the error signal in a predetermined period stays within the threshold range, the factor updater is allowed to update the control factor.

In the following description, embodiments will be each explained as a preferred specific embodiment of the present disclosure. In the following embodiments, constituent elements and their arrangement, connection forms, and operation orders are described as examples, and do not put limits on the present disclosure. The present disclosure is limited only by claims described herein.

Accordingly, among constituent elements included in the following embodiments, constituent elements not described in independent claims expressing the most superior concepts of the present disclosure are not always necessary for achieving the subject matter of the present disclosure, but will be explained as constituent elements making up a more preferable embodiment.

First Embodiment

Figure 1:
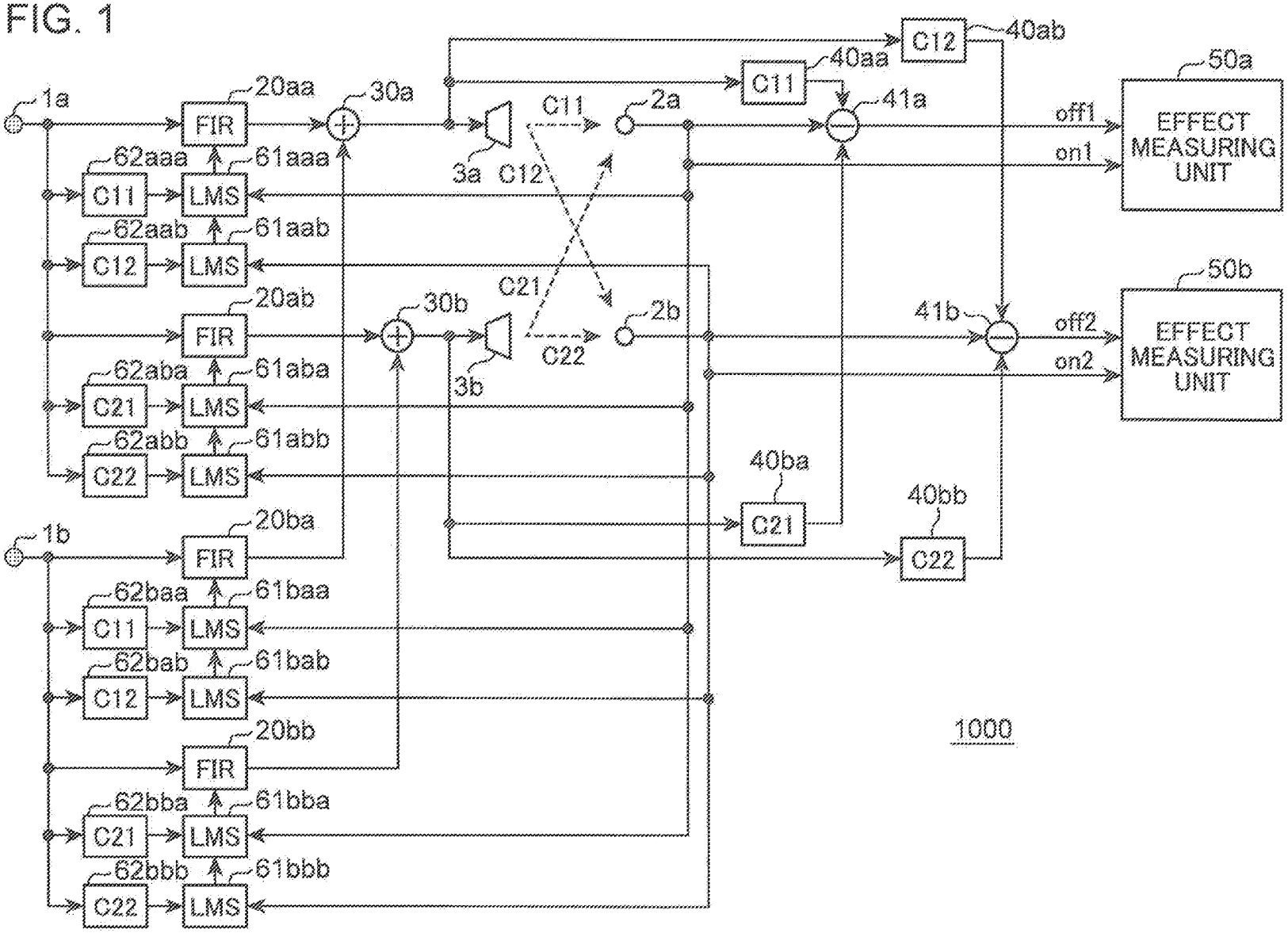
FIG. 1 is a configuration diagram of a noise controller according to a first embodiment.

A configuration of a noise controller according to a first embodiment will be described. FIG. 1 is a configuration diagram of a noise controller 1000 according to the first embodiment.

Similar to the conventional noise controller 1000*b* shown in FIG. 16, the noise controller 1000 reduces road noises caused by vibration signals indicative of vibrations detected by the sensors 1*a*, 1*b*, 1*c*, and 1*d* (FIGS. 15A and 15B) disposed on the suspension of the car 100, at control points, i.e., locations where the error microphones 2*a*, 2*b*, 2*c*, and 2*d* are disposed.

For simpler description, in the same manner as in FIG. 16 showing the conventional noise controller 1000*b*, FIG. 1 depicts only the constituent elements that the noise controller 1000 uses to perform control for reducing road noises at the front half part of the car 100. Actually, however, the noise controller 1000 further includes constituent elements incorporated in the rear half part of the car 100, the constituent elements being the same as the constituent elements shown in FIG. 1. Similar to the conventional noise controller 1000*b*, the noise controller 1000 performs the same control for reducing road noises both at the front half part and the rear half part of the car 100. In the following description, control for reducing, road noises the noise controller 1000 of FIG. 1 performs at the front half part of the car 100 will be explained in detail.

The two sensors 1*a* and 1*b*, the four control filters 20*aa*, 20*ab*, 20*ba*, and 20*bb*, the eight transmission characteristics correction filters 62*aaa*, 62*aab*, 62*aba*, 62*abb*, 62*baa*, 62*bab*, 62*bba*, and 62*bbb*, the eight LMS processing units 61*aaa*, 61*aab*, 61*aba*, 61*abb*, 61*baa*, 61*bab*, 61*bba*, and 61*bbb*, the two adders 30*a* and 30*b*, the two speakers 3*a* and 3*b*, and the two error microphones 2*a* and 2*b*, which are shown in FIG. 1, are the same in configuration as those shown in FIG. 16. Similar to the conventional noise controller 1000*b*, the noise controller 1000 reduces road noises caused by vibration signals indicative of vibrations detected by the sensors 1*a* and 1*b*, at the control points, i.e., locations where the error microphones 2*a* and 2*b* are disposed, by carrying out the adaptation operation of updating the control factors of the control filters 20*aa*, 20*ab*, 20*ba*, and 20*bb*.

Further, when each control factor has converged to an optimum value, the noise controller 1000 then carries out a fixing operation of fixing the control factor to the optimum value. A method performed by the noise controller 1000 for determining whether the control factor has converged to the optimum value will hereinafter be described.

First, at the error microphone 2*a*, road noises caused inside the car by vibration signals indicative of vibrations detected by the sensors 1*a* and 1*b* interfere with control sounds reproduced by the speakers 3*a* and 3*b*. As a result, an error signal, which indicates a residual noise left at the control point, location where the error microphone 2*a* is disposed, is output from the error microphone 2*a*. When a signal indicative of a road noise at the location where the error microphone 2*a* is disposed is denoted as N1, a signal reproduced by the speaker 3*a* is denoted as y1, and a signal reproduced by the speaker 3*b* is denoted as y2, an error signal e1 output from the error microphone 2*a* is expressed by an equation 1.

$$e1=N1+C11*y1+C21*y2 \quad \text{(equation 1)}$$

In this equation 1, C11 denotes characteristics of sound transmission from the speaker 3*a* to the error microphone 2*a*. C21 denotes characteristics of sound transmission from the speaker 3*b* to the error microphone 2*a*. * denotes a convolution operation.

The signal y1 is sent to a transmission characteristics correction filter 40*aa* and then to a subtractor 41*a*. The transmission characteristics correction filter (correction filter) 40*aa* performs a convolution process (signal processing or third signal processing) on the signal y1, using a factor that is the same coefficient used by the transmission characteristics correction filter 62*aaa* and approximate to the characteristics C11 of sound transmission from the speaker 3*a* to the error microphone 2*a*, and outputs the signal resulting from the convolution process to the subtractor 41*a*. In the same manner, the signal y2 is sent to a transmission characteristics correction filter 40*ba* and then to the subtractor 41*a*.

The subtractor 41*a* subtracts respective output signals from the transmission characteristics correction filters 40*aa* and 40*ba*, from the error signal output from the error microphone 2*a*. Specifically, the subtractor 41*a* carries out a calculation expressed by an equation 2.

$$\text{off1}=e1-C11*y1-C21*y2 \quad \text{(equation 2)}$$

In this equation 2, C11 denotes characteristics of sound transmission from the speaker 3*a* to the error microphone 2*a*, C21 denotes characteristics of sound transmission from the speaker 3*b* to the error microphone 2*a*. off1 denotes an output signal from the subtractor 41*a*.

Substituting the equation 1 in the equation 2 gives an equation 3, which expresses the output signal off1 from the subtractor 41*a*.

$$\text{off1}=\text{N1} \quad \text{(equation 3)}$$

This demonstrates that the output signal off1 from the subtractor 41*a* is identical with the signal indicative of the road noise at the location where the error microphone 2*a* is disposed, that is, the output signal off1 represents a noise not subjected yet to noise control by the interference between the road noise and the output signals from the two speakers 3*a* and 3*b* at the location where the error microphone 2*a* is disposed. The error signal e1 of the equation 1, on the other hand, is a signal on1 representing a noise having been subjected to noise control by the interference.

In other words, in the noise controller 1000, the signal off1 representing the noise not subjected yet to noise control by the interference between the road noise and the output signals from the two speakers 3*a* and 3*b* at the location where the error microphone 2*a* is disposed and the signal on1 representing the noise having been subjected to noise control by the interference are calculated simultaneously. The signal off1 representing the noise not subjected to the noise control yet and the signal on1 having been subjected to the noise control, both signals being calculated simultaneously, are input to an effect measuring unit 50*a*.

In the same manner, in the noise controller 1000, a signal off2 representing a noise not subjected yet to noise control by interference between a road noise and output signals from the two speakers 3*a* and 3*b* at the location where the error microphone 2*b* is disposed and a signal on2 representing a noise having been subjected to noise control by the interference are calculated simultaneously. The signal off2 representing the noise not subjected to the noise control yet and the signal on2 having been subjected to the noise control, both signals being calculated simultaneously, are input to an effect measuring unit 50*b*.

The effect measuring unit 50*a* measures a road noise reduction effect at the location where the error microphone 2*a* is disposed, based on the signal off1 (control-off signal) representing the noise not subjected yet to noise control by the interference between the road noise and the output signals from the two speakers 3*a* and 3*b* at the location where the error microphone 2*a* is disposed and on the signal on1 (control-on signal) representing the noise having been subjected to noise control by the interference. The effect measuring unit 50*b* measures a road noise reduction effect at the location where the error microphone 2*b* is disposed, based on the signal off2 (control-off signal) representing the noise not subjected yet to noise control by the interference between the road noise and the output signals from the two speakers 3*a* and 3*b* at the location where the error microphone 2*b* is disposed and on the signal on2 (control-on signal) representing the noise having been subjected to noise control by the interference.

Figure 2:
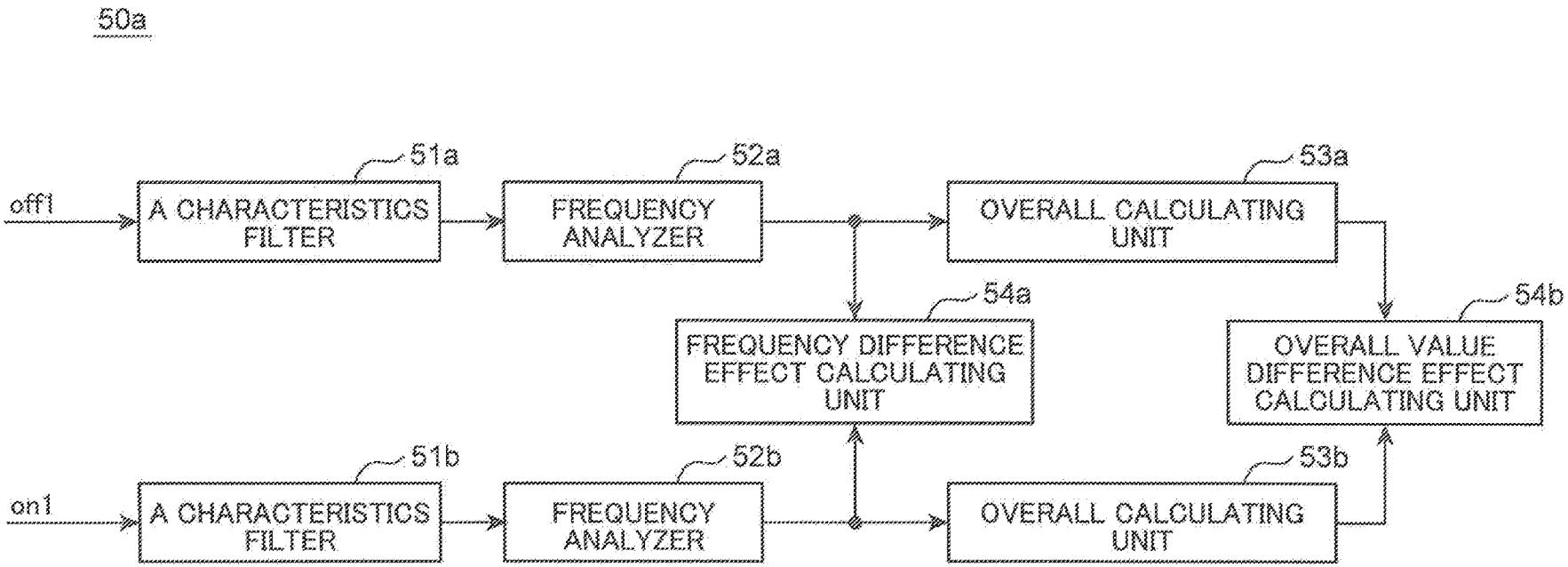
FIG. 2 is a diagram illustrating an example of a configuration of an effect measuring unit.

FIG. 2 is a diagram illustrating an example of a configuration of the effect measuring unit 50*a*. The effect measuring unit 50*b* is the same in configuration as the effect measuring unit 50*a*. In the following description, therefore, only the configuration of the effect measuring unit 50*a* will be described exemplarily. As shown in FIG. 2, the effect measuring unit 50*a* has two A characteristics filters 51*a* and 51*b*, two frequency analyzers 52*a* and 52*b*, two overall calculating units 53*a* and 53*b*, a frequency difference effect calculating unit 54*a*, and an overall value difference effect calculating unit 54*b*.

The signal off1 representing the noise not subjected yet to noise control by the interference between the road noise and the output signals from the two speakers 3*a* and 3*b* (hereinafter "pre-noise-control signal"), which is input to the effect measuring unit 50*a*, is input to the A characteristics filter 51*a*, while the signal on1 representing the noise having been subjected to noise control by the interference between the road noise and the output signals from, the two speakers 3*a* and 3*b* (hereinafter "post-noise-control signal"), which is input to the effect measuring unit 50*a*, is input to the A characteristics filter 51*b*.

The A characteristics filter 51*a* performs a convolution process (signal processing) on the incoming pre-noise-control signal off1, using a factor (A characteristics factor) indicative of A characteristics imitating the human auditory characteristics. Likewise, the A characteristics filter 51*b* performs a convolution process on the incoming post-noise-control signal on1, using a factor (A characteristics factor) indicative of A characteristics imitating the human auditory characteristics.

The frequency analyzer 52*a* performs a predetermined frequency analysis, such as fast Fourier transform (FFT), on the pre-noise-control signal off1 having been subjected to the convolution process by the A characteristics filter 51*a* to calculate the frequency characteristics of the pre-noise-control signal off1. The frequency analyzer 52*b* performs a predetermined frequency analysis, such as FFT, on the post-noise-control signal on1 having been subjected to the convolution process by the A characteristics filter 51*b* to calculate the frequency characteristics of the post-noise-control signal on1.

For each frequency making up the frequency characteristics calculated by the frequency analyzer 52*a* and frequency analyzer 52*b*, the frequency difference effect calculating unit 54*a* calculates a difference (first difference) between the pre-noise-control signal off1 having been subjected to the convolution process by the A characteristics filter 51*a* and the post-noise-control signal on1 having been subjected to the convolution process by the A characteristics filter 51*b*, as an index for a road noise reduction effect at the location where the error microphone 2*a* is disposed.

The overall calculating unit 53*a* calculates an overall value for the pre-noise-control signal off1 in its whole frequency band, using the frequency characteristics of the pre-noise-control signal off1 having been subjected to the convolution process by the A characteristics filter 51*a*, the frequency characteristics being calculated by the frequency analyzer 52*a*. The overall value calculated by the overall calculating unit 53*a* will hereinafter be referred to as first overall value. The overall calculating unit 53*b* calculates an overall value for the post-noise-control signal on1 in its whole frequency band, using the frequency characteristics of the post-noise-control signal on1 having been subjected to the convolution process by the A characteristics filter 51*b*, the frequency characteristics being calculated by the frequency analyzer 52*b*. The overall value calculated by the overall calculating unit 53*b* will hereinafter be referred to as second overall value.

The overall value difference effect calculating unit 54*b* calculates a difference (second difference) between the first overall value calculated by the overall calculating unit 53*a* and the second overall value calculated by the overall calculating unit 53*b*, as an index for a road noise reduction effect at the location where the error microphone 2*a* is disposed.

Figure 3:
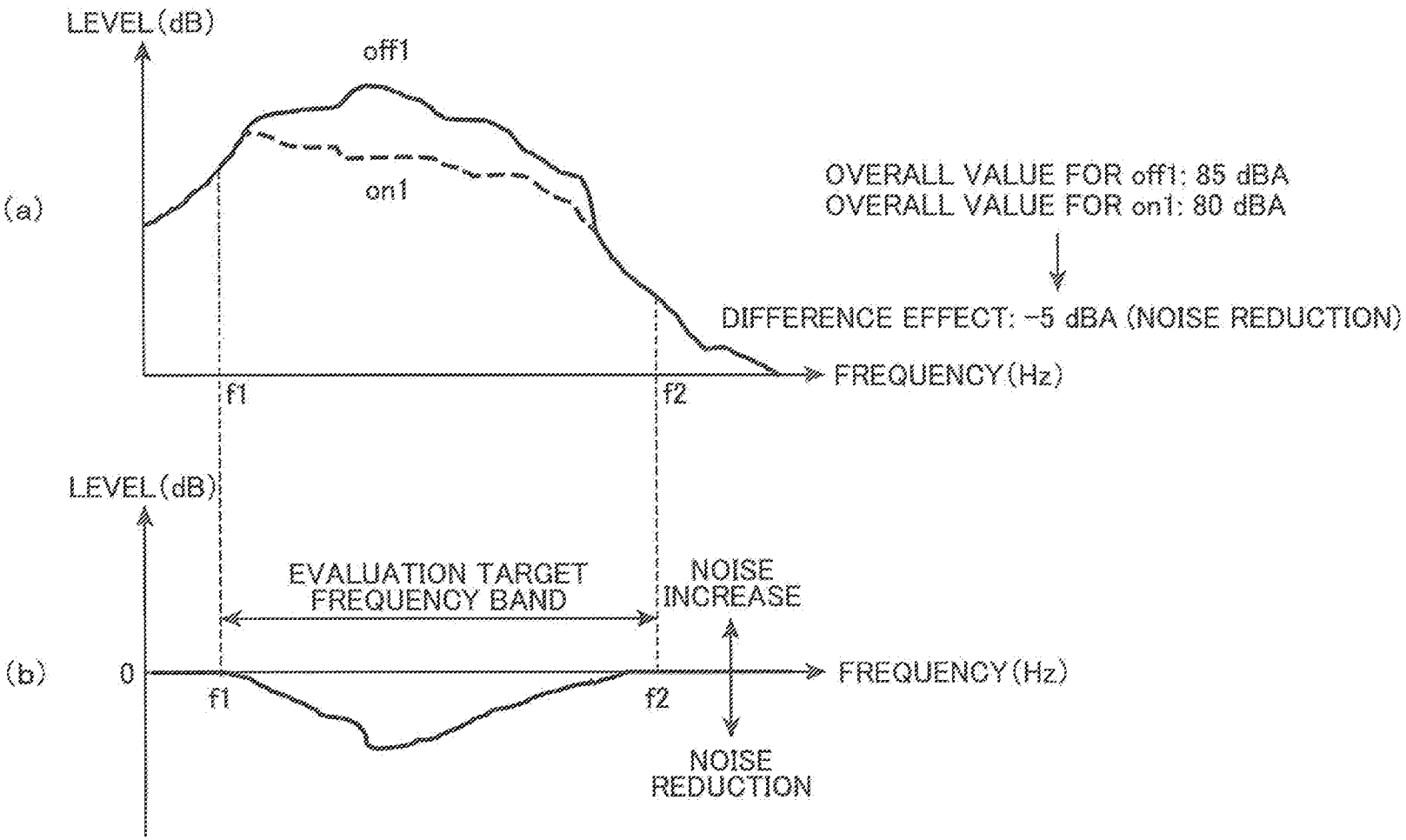
FIG. 3 is a diagram illustrating an example of a noise reduction effect measured by the effect measuring unit.

FIG. 3 is a diagram illustrating an example of a noise reduction effect measured by the effect measuring unit 50*a*. A section (a) of FIG. 3 shows the frequency characteristics of the pre-noise-control signal off1 calculated by the frequency analyzer 52*a*, as a continuous line curve, while shows the frequency characteristics of the post-noise-control signal on1 calculated by the frequency analyzer 52*b*, as a broken line curve. A section (b) of FIG. 3 shows a first difference for each frequency calculated by the frequency difference effect calculating unit 54*a*, the first difference corresponding to a difference between the frequency characteristics indicated by the continuous line and the frequency characteristics indicated by the broken line in the section (a) of FIG. 3.

For example, observing the sections (a) and (b) of FIG. 3 leads to understanding that, at the location where the error microphone 2*a* is disposed, a road noise with a frequency ranging from f1 to f2 inclusive, the road noise corresponding to the first difference below a 0 dB line, is reduced. Because no frequency corresponding to the first difference exists above the 0 dB line, it is understood that road noise does not increase in the entire frequency range.

On the right to the frequency characteristics curves shown in the section (a) of FIG. 3, the first overall value (e.g., 85 dBA) calculated by the overall calculating unit 53*a* and the second overall value (e.g., 80 dBA) calculated by the overall calculating unit 53*b* are indicated. On the right to the frequency characteristics curves shown in the section (a) of FIG. 3, the second difference representing a difference between the first overall value and the second overall value (e.g., −5 dBA), the second difference being calculated by the overall value difference effect calculating unit 54*b*, is also indicated. The example of the section (a) of FIG. 3 indicates the second difference of −5 dBA, thus demonstrating that the road noise is reduced by 5 dBA at the location where the error microphone 2*a* is disposed.

When it is desired to evaluate the road noise reduction effect without taking the human auditory characteristics into consideration, the effect measuring unit 50*a* may dispense with the A characteristics filters 51*a* and 51*b*. In such a case, the frequency analyzer 52*a* may calculate the frequency characteristics of the pre-noise-control signal (control-off signal) off1 input to the effect measuring unit 50*a* and the frequency analyzer 52*b* may calculate the frequency characteristics of the post-noise-control signal (control-on signal) on1 input to the effect measuring unit 50*a*.

The effect measuring unit 50*a* then performs the determination process of determining whether the road noise effect at the location where the error microphone 2*a* is disposed has achieved the target value, using the first difference for each frequency calculated by the frequency difference effect calculating unit 54*a* and the second difference calculated by the overall value difference effect calculating unit 54*b*.

Specifically, carrying out the determination process, the effect measuring unit 50*a* determines whether the road noise effect at the location where the error microphone 2*a* is disposed has achieved the target value, according to criterion described in 1) and 2) below.

1) When the first difference at over half of the entire frequencies included in a predetermined evaluation target frequency band (e.g., frequencies ranging from f1 to f2 shown in the sections (a) and (b) of FIG. 3) has achieved a preset first target value, the effect measuring unit 50*a* determines that the road noise effect has achieved the target value. The effect measuring unit 50*a* may perform the determination process under severer conditions. For example, when the first difference at a predetermined number or more of over half (e.g., 70% or more) of the entire frequencies included in the evaluation target frequency band has achieved the first target value, the effect measuring unit 50*a* may determine that the road noise effect has achieved the target value.

2) When the second difference has achieved a preset second target value different from the first target value, the effect measuring unit 50*a* determines that the road noise effect has achieved the target value.

In the same manner as the effect measuring unit 50*a*, the effect measuring unit 50*b* performs the determination process of determining whether the road noise effect at the location where the error microphone 2*b* is disposed has achieved the target value.

A case is assumed where the effect measuring units 50*a* and 50*b*, having carried out the determination process, determine that the road noise reduction effect has achieved the target value at each of the locations where all of the error microphone 2*a* and 2*b* arranged inside the car are disposed. In this case, the effect measuring unit 50*a* or effect measuring unit 50*b* determines that the control factors of the filters

20*aa*, 20*ab*, 20*ba*, and 20*bb* have all converged to their respective optimum values, thus stopping the adaptation operation.

Specifically, the effect measuring unit 50*a* or effect measuring unit 50*b* stops the eight LMS processing units (factor updaters) 61*aaa*, 61*aab*, 61*aba*, 61*abb*, 61*baa*, 61*bab*, 61*bba*, and 61*bbb* from updating the control factors of the four control filters 20*aa*, 20*ab*, 20*ba*, and 20*bb*. The effect measuring unit 50*a* or effect measuring unit 50*b* then fixes each of the control factors of the four control filters 20*aa*, 20*ab*, 20*ba*, and 20*bb* to a control factor value that is set when the effect measuring unit 50*a* or effect measuring unit 50*b* determines that each control factor has converged to the optimum value.

According to the above configuration, the pre-noise-control signals off1 and off2, which represent road noises not subjected yet to noise control by interference between road noises and control sounds reproduced by the speakers 3*a* and 3*b* at the control points, i.e., the locations where the error microphones 2*a* and 2*b* are disposed, and the post-noise-control signals on1 and on2, which represent road noises having been subjected to noise control by the interference at the control points, can be obtained simultaneously.

Based on output signals from the transmission characteristics correction filters 40*aa* and 40*ba*, the output signals representing a difference between the pre-noise-control signal off1, which is given by subtracting output signals from the transmission characteristics correction filters 40*aa* and 40*ba*, from an error signal indicative of a residual noise detected by the error microphone 2*a*, and the post-noise-control signal on1, which is the error signal indicative of the residual noise detected by the error microphone 2*a*, the noise control effect at the location where the error microphone 2*a* is disposed is measured.

Even if a sound irrelevant to a noise created by a noise source to be target propagates to the control point and, consequently, the sound irrelevant to the noise created by the noise source is included in the error signal indicative of the residual noise detected by the error microphone 2*a*, therefore, the noise reduction effect at the location where the error microphone 2*a* is disposed can be measured precisely based only on output signals from the transmission characteristics correction filters 40*aa* and 40*ba*, the output signals being irrelevant to the sound irrelevant to the noise.

As a result, for example, the car manufacturer does not need to cause each car 100 to be sold to run the test course to determine the control factor of each of the control filters 20*aa*, 20*ab*, 20*ba*, and 20*bb*. The user is allowed to properly set the control factor of each of the control filters 20*aa*, 20*ab*, 20*ba*, and 20*bb* while driving the car 100.

In the case of a noise with a wide frequency hand, such as road noise, once determining the control factor maintains a specific effect without a need of changing the control factor frequently. In such a case, therefore, the control filters 20*aa*, 20*ab*, 20*ba*, and 20*bb* are each operated using a preset control factor to measure the noise reduction effect at the location where the error microphone 2*a* is disposed.

Figure 18:
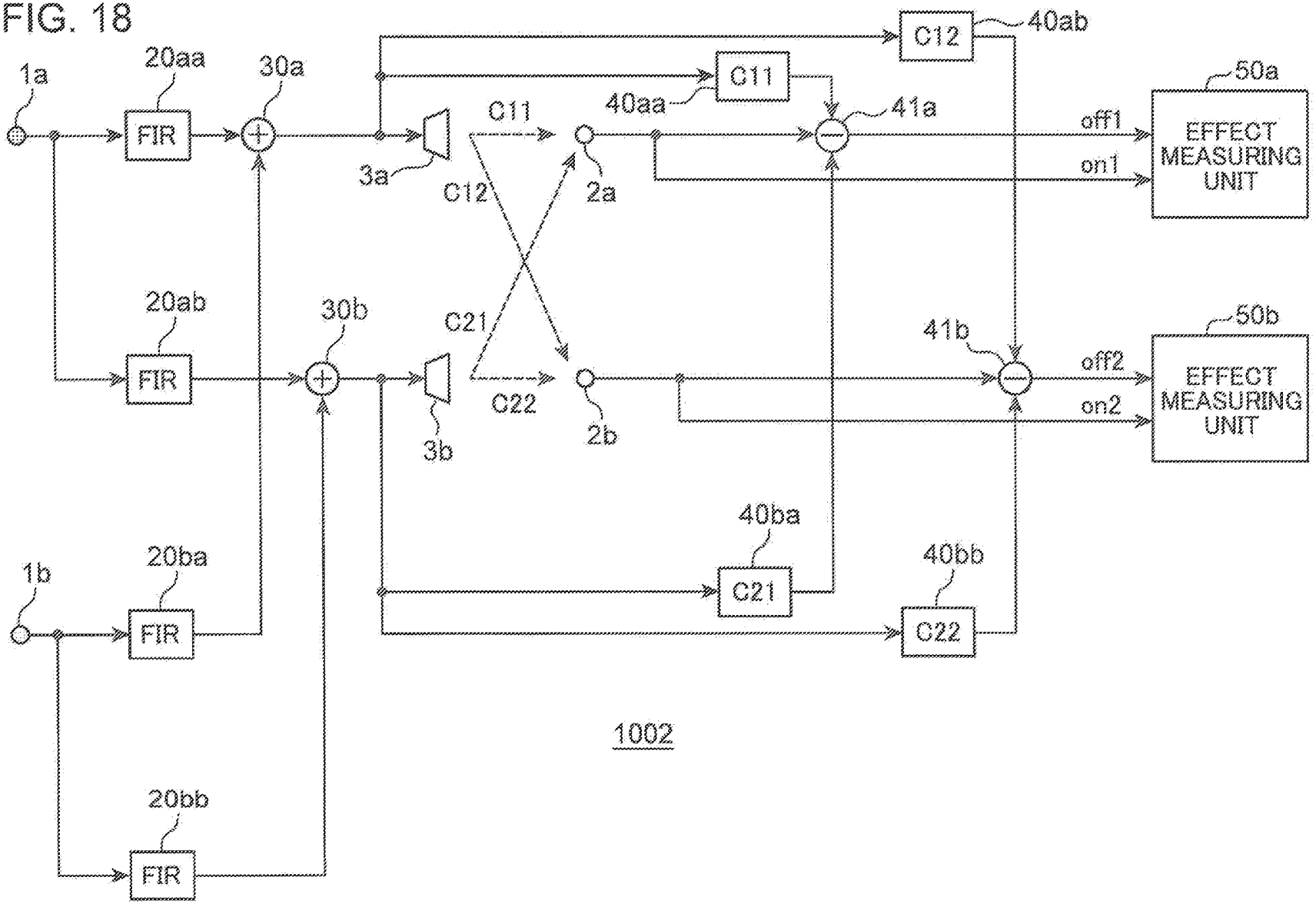
FIG. 18 is a configuration diagram of a modification of the noise controller according to the first embodiment.

FIG. 18 is a configuration diagram of a modification of the noise controller 1000 according to the first embodiment. In the case of such a modification, the LMS processing units 61*aaa* to 61*bbb* and the transmission characteristics correction filters 62*aaa* to 62*bbb* may be removed from the noise controller 1000 (FIG. 1). Removing these components provides a noise controller 1002 having a simplified configuration, as shown in FIG. 18.

Specifically, the noise controller 1002, which performs control for reducing road noises at the front half part of the car 100, may include two sensors 1*a* an 1*b*, four control filters 20*aa*, 20*ab*, 20*ba*, and 20*bb* that perform a convolution process on vibration signals output from the two sensors 1*a* an 1*b*, using preset control factors, two adders 30*a* and 30*b*, two speakers 3*a* an 3*b*, two error microphones 2*a* and 2*b*, four transmission characteristics correction filters (correction filters) 40*aa*, 40*ab*, 40*ba*, and 40*bb*, two subtractors 41*a* and 41*b*, and two effect measuring units 50*a* and 50*b*.

Figure 4:
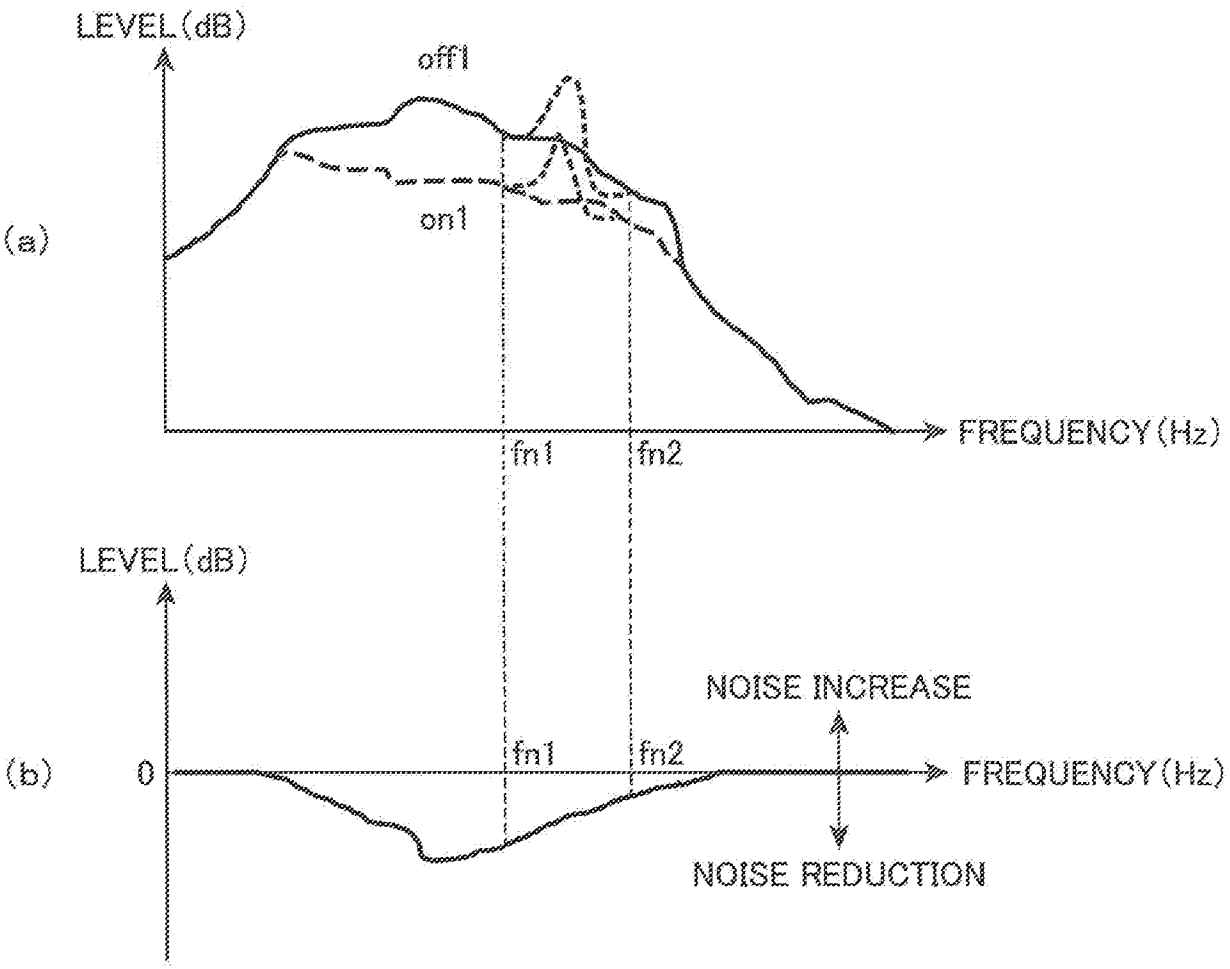
FIG. 4 is a diagram illustrating another example of the noise reduction effect measured by the effect measuring unit.

FIG. 4 is a diagram illustrating another example of the noise reduction effect measured by the effect measuring unit 50*a*. In the same manner as the section (a) of FIG. 3, a section (a) of FIG. 4 shows the frequency characteristics of the pre-noise-control signal off1 calculated by the frequency analyzer 52*a*, as a continuous line curve, while shows the frequency characteristics of the post-noise-control signal on1 calculated by the frequency analyzer 52*b*, as a broken line curve. In the same manner as the section (b) of FIG. 3, a section (b) of FIG. 4 shows a first difference for each frequency calculated by the frequency difference effect calculating unit 54*a*, the first difference corresponding to a difference between the frequency characteristics indicated by the continuous line in the section (a) of FIG. 4 and the frequency characteristics indicated by the broken line in the section (a).

The section (a) of FIG. 4 also shows the frequency characteristics of the pre-noise-control signal off1 and the frequency characteristics of the post-noise-control signal on1 that result when a noise propagating to the error microphone 2*a* changes during measurement by the effect measuring unit 50*a* of the road noise reduction effect, both frequency characteristics being indicated by dotted lines. For example, the noise propagating to the error microphone 2*a* changes when the traveling speed of the car 100 changes or the condition of a road surface on which the car 100 is traveling changes or the like. The noise propagating to the error microphone 2*a* changes also when occupants make a conversation, a car audio replays a music or the like, a navigation system issues a voice guide message, a large vehicle, such as a truck, brushes past against the car 100, or the like.

According to the above configuration, as indicated by the dotted lines in the section (a) of FIG. 4, a change in the noise propagating to the error microphone 2*a* produces a change in the frequency characteristics of the pre-noise-control signal off1 and a change in the frequency characteristics of the post-noise-control signal on1, both changes being the same. As a result, as indicated in the section (b) of FIG. 4, the first difference at each frequency in this example is equal in characteristics with the first difference shown in the section (b) of FIG. 3.

This can be confirmed from the above equations 1, 2, and 3. It is confirmed because in an assumed case where the signal N1 indicative of the road noise at the location where the error microphone 2*a* is disposed changes to a signal N1', substituting the equation 1 with N1 replaced with N1' in the equation 2 gives off1=N1', which is similar to off1=N1, i.e., equation 3. In other words, the same signal N1' indicative of the changed noise is included in the post-noise-control signal on1, which is the error signal e1 output from the error microphone 2*a*, and in the pre-noise-control signal off1 as well. For this reason, calculating a difference between the post-noise-control signal on1 and the pre-noise-control signal off1 cancels out the signal N1'.

Figure 5:
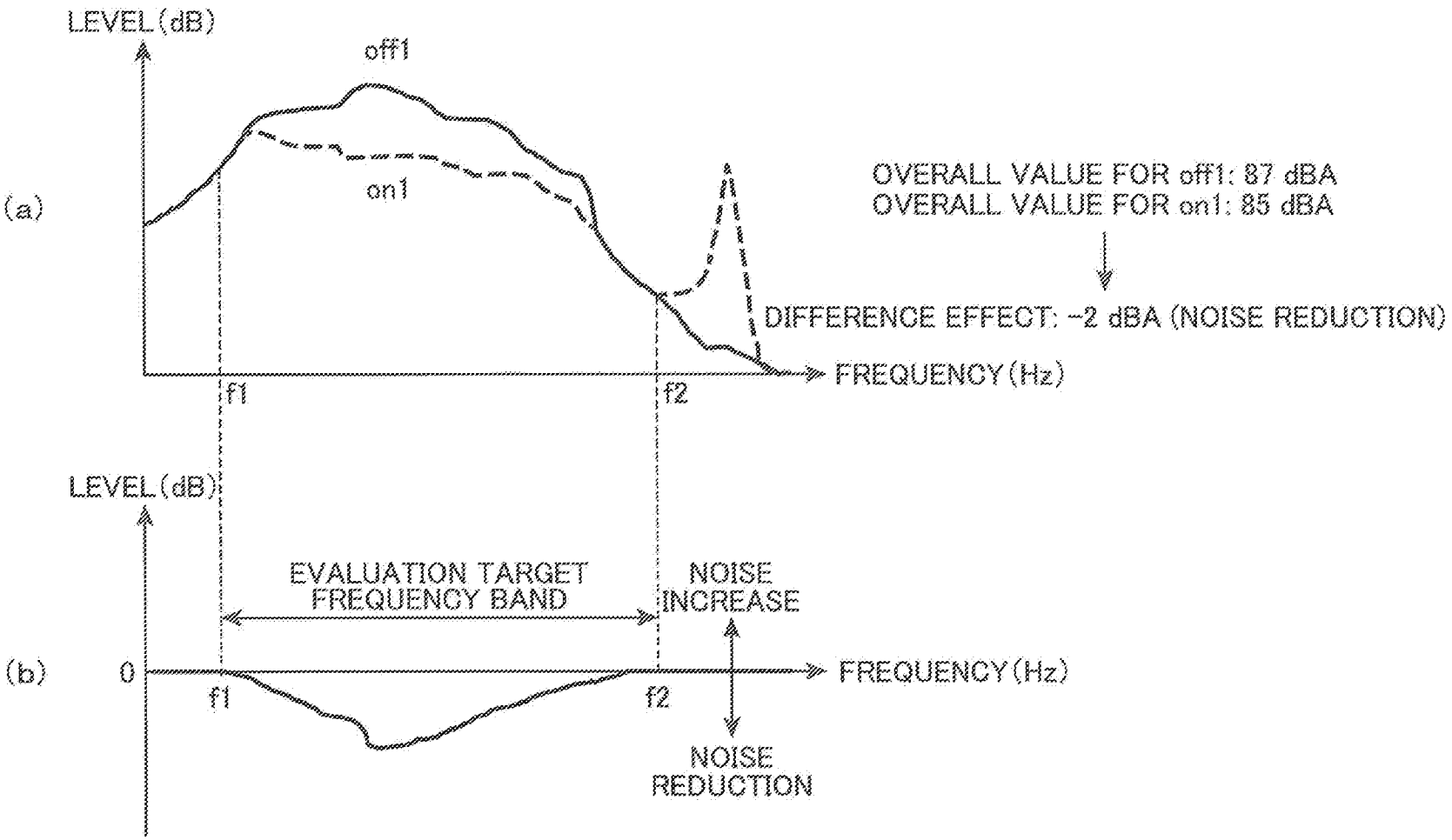
FIG. 5 is a diagram illustrating still another example of the noise reduction effect measured by the effect measuring unit.

As shown in FIG. 4, when a sound with a frequency within the evaluation target frequency hand (frequencies ranging from f1 to f2) is created as a sound irrelevant to the noise to be reduced, no particular serious problem arises in the configuration described above. FIG. 5 is a diagram illustrating still another example of the noise reduction effect measured by the effect measuring unit 50*a*. A case is assumed where, as indicated by a dotted line in a section (a) of FIG. 5, a sound with a frequency outside the evaluation target frequency hand is created as an irrelevant sound irrelevant to the noise to be reduced, and the level of the irrelevant sound is not sufficiently small relative to the level of a sound with a frequency within the evaluation target frequency band. In this case, as shown in a section (b) of FIG. 5, the first difference is the same as the first differences shown in the sections (b) of FIGS. 3 and 4. However, the level of the irrelevant sound affects a first overall value and a second overall value, in which case a second difference, i.e., difference between the first overall value and the second overall value, may differ from a second difference calculated in a ease where the irrelevant sound does not exist.

For example, in the example shown in the section (a) of FIG. 5, the first overall value representing the overall value for the pre-noise-control signal off1 is 87 dBA, which is a 2 dBA increase from the one shown in the section (a) of FIG. 3. The second overall value representing the overall value for the post-noise-control signal on1 is 85 dBA, which is a 5 dBA increase from the one shown in the section (a) of FIG. 3. As a result, the second difference, i.e., difference between the first overall value and the second overall value is given as −2 dBA. This indicates that the noise reduction effect in this example has dropped by 3 dBA from the one shown in the section (a) of FIG. 3.

In this manner, when a problem with the first difference shown in the section (b) of FIG. 5 does not occur but a problem with the second difference occurs, it hinders setting of a second target value, which is a target value for the second difference, and determination on whether the second target value has been achieved.

Figure 6:
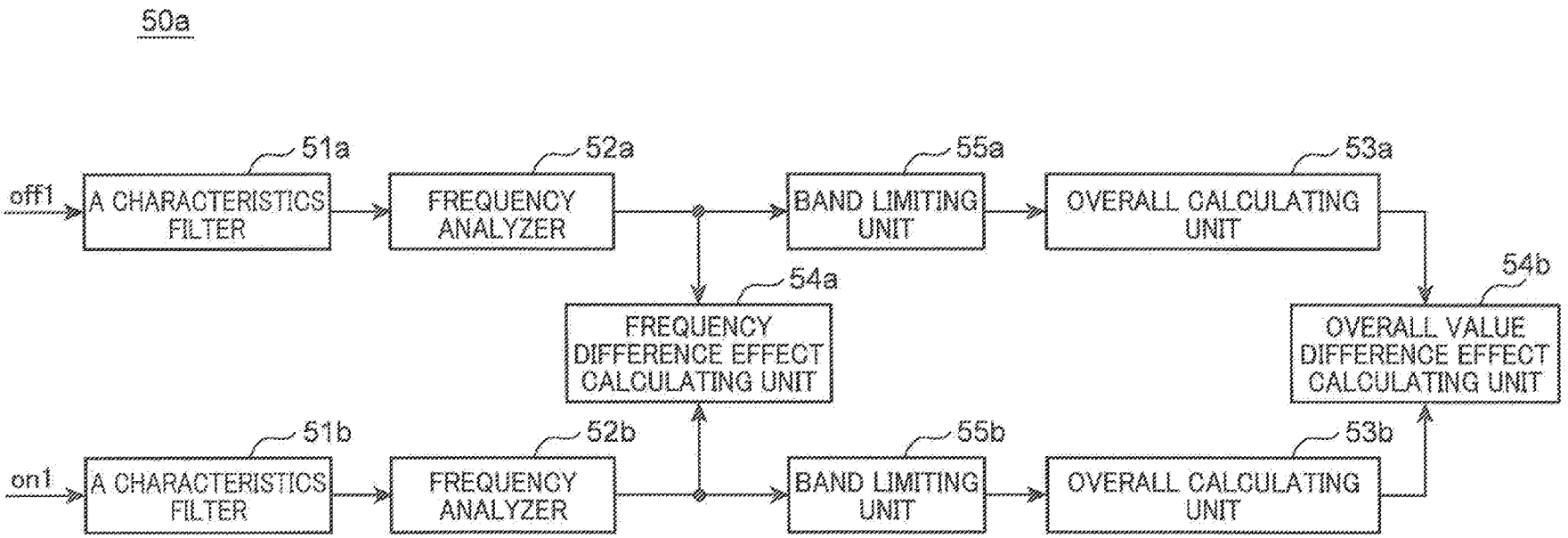
FIG. 6 is a diagram illustrating an example of another configuration effect measuring unit.

To prevent such a case, the configuration of the effect measuring unit 50*a* may be changed, as shown in FIG. 6. FIG. 6 is a diagram illustrating an example of another configuration of the effect measuring unit 50*a*. As shown in this configuration, the effect measuring unit 50*a* may further have band limiting units 55*a* and 55*b*. The band limiting unit 55*a* may extract only the signal with a frequency within the evaluation target frequency band (frequencies ranging from f1 to f2) from the pre-noise-control signal off1, using the frequency characteristics of the pre-noise-control signal off1, the frequency characteristics being calculated by the frequency analyzer 52*a*, and output the extracted signal to the overall calculating unit 53*a*. In the same manner, the hand limiting unit 55*b* may extract only the signal with a frequency within the evaluation target frequency band (frequencies ranging from f1 to f2) from the post-noise-control signal on1, using the frequency characteristics of the post-noise-control signal on1, the frequency characteristics being calculated by the frequency analyzer 52*b*, and output the extracted signal to the overall calculating unit 53*b*.

Then, the overall value difference effect calculating unit 54*b* may calculate a second difference, which is a difference between a first overall value calculated by the overall calculating unit 53*a* and a second overall value calculated by the overall calculating unit 53*b*. The calculated second difference may be used as an index for the road noise reduction effect at the location where the error microphone 2*a* is disposed.

In the first embodiment, the example of applying the noise controller 1000 to the car 100 has been described. The noise controller 1000, however, may be applied also to airplanes, trains, and the like.

Second Embodiment

A configuration of a noise controller according to a second embodiment will be described.

It has been described in the first embodiment that the adaptation operation of updating the control factor and measurement of the road noise reduction effect can be carried out simultaneously. However, when the driver plays the audio with a large sound volume, a truck bigger than the car 100 runs parallel with the car 100, or the like, a noise larger than a road noise created by the driver's driving the car 100 propagates through the car interior. This may exert a negative effect on the adaptation operation of updating the control factor.

To deal with such a case, a noise controller 1001 according to the second embodiment carries out the adaptation operation only when predetermined conditions not having a negative effect on the adaptation operation are met. In this respect, the noise controller 1001 is different from the noise controller 1000 according to the first embodiment. When the adaptation operation is stopped and the control factor is fixed, the control factor does not change even if a noise larger than the road noise propagates through the car interior. It is therefore unnecessary to make the configuration in such a case different from the configuration of the first embodiment.

A flow of the adaptation operation carried out by the noise controller 1001 according to the second embodiment will hereinafter be described. In the following description, the eight LMS processing units 61*aaa*, 61*aab*, 61*aba*, 61*abb*, 61*baa*, 61*bab*, 61*bba*, and 61*bbb* and the eight transmission characteristics correction filters 62*aaa*, 62*aab*, 62*aba*, 62*abb*, 62*baa*, 62*bab*, 62*bba*, and 62*bbb* may be collectively referred to as factor updater 60 in some cases. The two effect measuring units 50*a* and 50*b* may be collectively referred to as effect measuring unit 50 in some cases.

Figure 7:
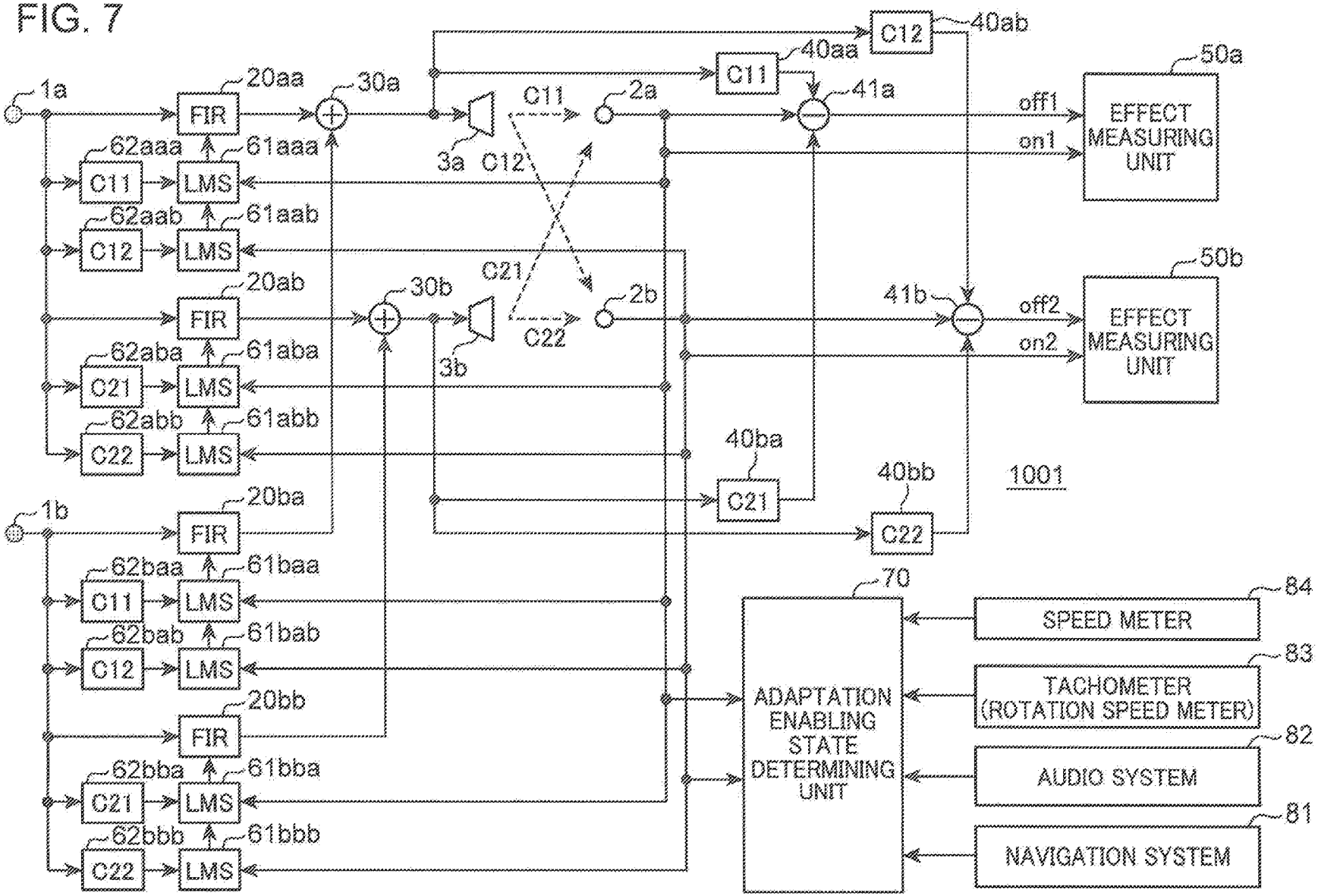
FIG. 7 is a configuration diagram of a noise controller according to a second embodiment.

FIG. 7 is a configuration diagram of the noise controller 1001 according to the second embodiment. As shown in FIG. 7, the noise controller 1001 includes an adaptation enabling state determining unit 70, in addition to the constituent elements making up the noise controller 1000 (FIG. 1) according to the first embodiment. The adaptation enabling state determining unit 70 is provided as a result of the CPU executing a program stored in advance in the ROM. The adaptation enabling state determining unit 70 determines whether an environment of the car interior meets predetermined adaptation conditions for carrying out the adaptation operation, thereby determines whether or not to cause the factor updater 60 to update the control factor.

Figure 8:
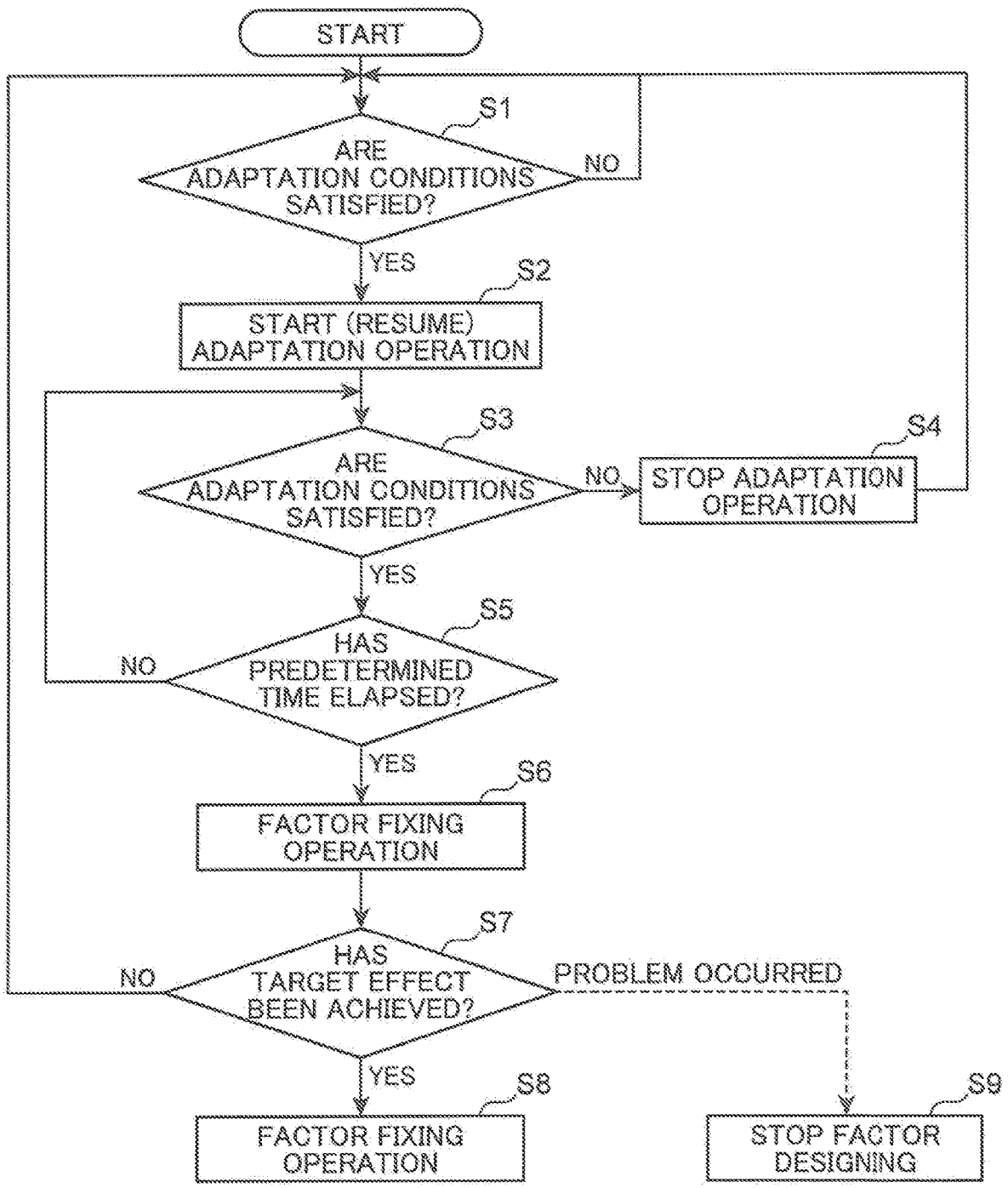
FIG. 8 is a flowchart showing a flow of an adaptation operation.

FIG. 8 is a flowchart showing a flow of the adaptation operation. As shown in FIG. 8, when the adaptation operation starts at a predetermined point of time, the point of time is at which the noise controller 1001 is supplied with power, or the like, the adaptation enabling state determining unit 70 determines whether an environment of the car interior meets adaptation conditions for carrying out the adaptation operation (step S1). When it is determined at step S1 that the environment meets the adaptation conditions (YES at step S1), the effect measuring unit 50 causes the factor updater 60 to carry out the adaptation operation (step S2). The details of step S1 will be described later on.

Subsequently, as the adaptation operation is being carried out, the adaptation enabling state determining unit 70 executes the same determination process as it has executed at step S1 (step S3). When it is determined at step S3 that the environment does not meet the adaptation conditions (NO at step S3), the effect measuring unit 50 causes the factor updater 60 to stop carrying out the adaptation operation (step S4). Then, step S1 and other steps to follow are executed again. The details of step S3 will be described later on.

When determining at step S3 that the environment meets the adaptation conditions (YES at step S3), the effect measuring unit 50 determines whether a predetermined time (e.g., 30 seconds) has elapsed from the start of the adaptation operation at step S2 while causing the factor updater 60 to continue the adaptation operation (step S5). When determining at step S5 that the predetermined. time has elapsed (YES at step S5), the effect measuring unit 50 causes the factor updater 60 to end the adaptation operation, and carries out a factor fixing operation of fixing the control factor to a control factor value set at the time of ending the adaptation operation (step S6).

The effect measuring unit 50, as described in the first embodiment, then performs the determination process of determining whether a road noise reduction effect has achieved the target value at the control point, i.e., the location where each error microphone is disposed (step S7). When determining at step S7 that the road noise reduction effect has not achieved the target value (NO at step S7), the effect measuring unit 50 returns to step S1. When determining at step S7 that the road noise reduction effect has achieved the target value (YES at step S7), the effect measuring unit 50 continues the factor fixing operation (step S8). When determining that a problem with the control factor has occurred during execution of step S7, the effect measuring unit 50 stops control factor designing (step S9).

Step S1 and step S3 will then be described in detail. As shown in FIG. 7, the adaptation enabling state determining unit 70 receives information from a navigation system 81, an audio system 82, a tachometer (rotating speed meter) 83, and a speed meter 84. The adaptation enabling state determining unit 70 receives also incoming output signals from the error microphones 2*a* and 2*b*.

Incoming information from the audio system 82 to the adaptation enabling state determining unit 70 includes, for example, an audio signal and switch information indicating whether the audio system 82 is started. When the incoming switch information from the audio system 82 indicates that the audio system 82 is started, the adaptation enabling state determining unit 70 determines that the adaptation conditions are not met. When the level of the incoming audio signal from the audio system 82 is equal to or higher than a predetermined threshold, the adaptation enabling state determining unit 70 determines that the adaptation conditions are not met.

Incoming information from the navigation system 81 to the adaptation enabling state determining unit 70 includes, for example, a voice guide signal. When the level of the incoming voice guide signal from the navigation system 81 is equal to or higher than a predetermined threshold, the adaptation enabling state determining unit 70 determines that the adaptation conditions are not met.

To the adaptation enabling state determining unit 70, the tachometer 83 inputs an engine rotating speed, which is related to the road noise. When the input engine rotating speed is equal to or lower than a predetermined first rotating speed (e.g., 1000 rpm) or equal to or higher than a predetermined second rotating speed (e.g., 4000 rpm), the adaptation enabling state determining unit 70 determines that the adaptation conditions are not met. To the adaptation enabling state determining unit 70, the speed meter 84 inputs a traveling speed, which is related to the road noise. When the input traveling speed is equal to or lower than a predetermined first speed (e.g., 40 km/h) or equal to or higher than a predetermined second speed (e.g., 130 km/h), the adaptation enabling state determining unit 70 determines that the adaptation conditions are not met.

The adaptation enabling state determining unit 70 makes determinations in this manner for the following reason. When the traveling speed or the engine rotating speed is low, a road noise level under such a condition is assumed to be lower than a road noise level under a normal traveling condition, which leads to a conclusion that the load noise level does not reach a level for meeting the adaptation conditions. When the traveling speed or the engine rotating speed is considerably high, a road noise level under such a condition is assumed to be higher than the road noise level under the normal traveling condition, which leads to a conclusion that the load noise level exceeds the level for meeting the adaptation condition.

Incoming signals from the error microphones 2*a* and 2*b* to the adaptation enabling state determining unit 70 indicate exactly sounds propagating through the car interior environment. These sounds include road noises created by driving, voices of occupants in conversation, sounds reproduced by the audio system 82, guide messages from the navigation system 81, and external noises propagating to the car interior (e.g., noises from other vehicles running parallel with or brushing past the car). For this reason, when the level of incoming signals from the error microphones 2*a* and 2*b* is equal to or higher than a first threshold and equal to or lower than a second threshold, the adaptation enabling state determining unit 70 determines that the adaptation conditions are not met.

Figure 9A:
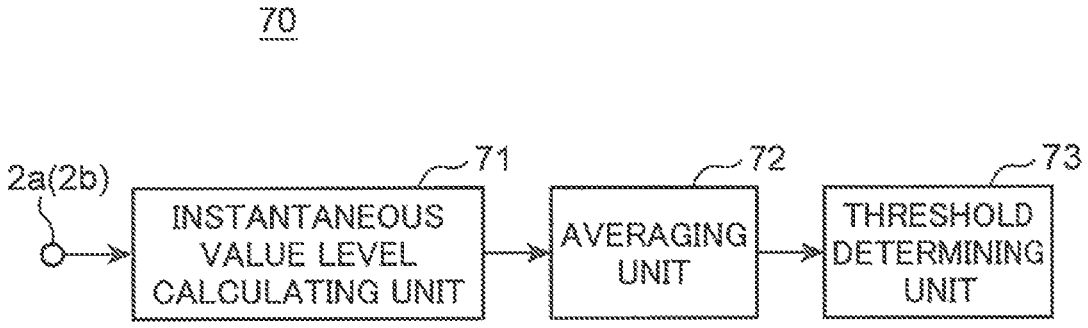
FIG. 9A is a configuration diagram of an adaptation enabling state determining unit.
Figure 9B:
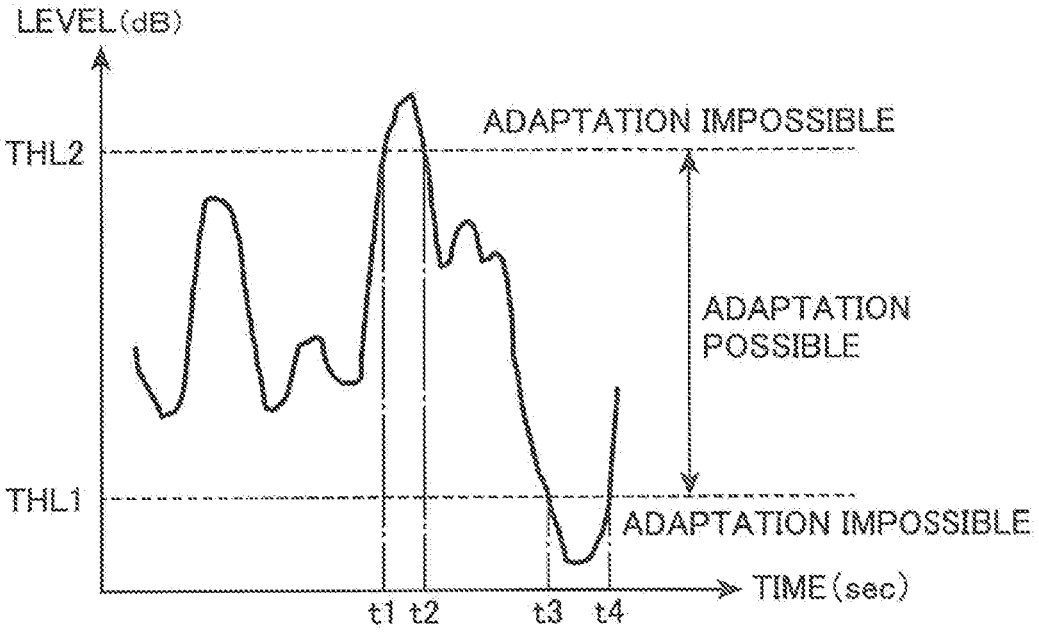
FIG. 9B is a diagram illustrating an example of determination conditions used by the adaptation enabling state determining unit.

A method by which the adaptation enabling state determining unit 70 measures the level of an incoming signal will then be described. FIG. 9A is a configuration diagram of the adaptation enabling state determining unit 70. FIG. 9B is a diagram illustrating an example of determination conditions used by the adaptation enabling state determining unit 70. As shown in FIG. 9A, the adaptation enabling state determining unit 70 has an instantaneous value level calculating unit 71, an averaging unit 72, and a threshold determining unit 73.

The instantaneous value level calculating unit 71 calculates an instantaneous value level (e.g., −26 dB) at a moment when an output signal from the error microphone 2*a* is input to the instantaneous value level calculating unit 71.

The averaging unit 72 averages instantaneous value levels calculated by the instantaneous value level calculating unit 71 in a predetermined period. The predetermined period may be defined in term of time, in which case it is defined as, for example, 1/10 seconds, or may be determined in terms of the number of instantaneous value levels input, in which case it is defined as, for example, a period in which 1000 instantaneous value levels are input.

The threshold determining unit 73 determines whether an average signal level (value) given by the averaging unit 72 is within a predetermined threshold range. FIG. 9B shows a graph indicating time-dependent changes in an average signal level given by the averaging unit 72, and a lower limit THL1 and an upper limit THL2 of the threshold range. When the average signal level is equal to or higher than the lower limit THL1 and equal to or lower than the upper limit THL2, the threshold determining unit 73 determines that the adaptation conditions are met.

As shown in the graph of FIG. 9B, when the average signal level (value) given by the averaging unit 72 is input to the threshold determining unit 73, the average signal level stays within the threshold range until time t1 arrives. The threshold determining unit 73 thus determines that the adaptation conditions are met in this period. In a period between time t1 and time t2, the average signal level exceeds the upper limit THL2. The threshold determining unit 73 thus determines that the adaptation conditions are not met. In a period between time t2 and time t3, the average signal level stays within the threshold range. The threshold determining unit 73 thus determines again that the adaptation conditions are met. In a period between time t3 and time t4, the average signal level remains lower than the lower limit THL1. The threshold determining unit 73 thus determines that the adaptation conditions are not met.

An example in which the adaptation enabling state determining unit 70 determines whether the adaptation condition are met when an output signal from the error microphone 2*a* is input to the instantaneous value level calculating unit 71 has been described with reference to FIGS. 9A and 9B. The adaptation enabling state determining unit 70 performs the same determination process when an output signal from the error microphone 2*b* is input to the instantaneous value level calculating unit 71. As described above, information used by the adaptation enabling state determining unit 70 to determine whether the adaptation condition are met includes not only the output signals from the error microphones 2*a* and 2*b* but also incoming information from the audio system 82 and the speed meter 84. The adaptation enabling state determining unit 70 thus makes determinations on whether the adaptation conditions are met, using all pieces of information input to the adaptation enabling state determining unit 70 for carrying out individual determination processes. When all the determination processes lead to the determination that the adaptation conditions are met, the adaptation enabling state determining unit 70 determines that the car interior environment meets the adaptation conditions for carrying out the adaptation operation.

According to the above configuration, the factor updater 60 executes control factor updating only when the adaptation enabling state determining unit 70 determines that the car interior environment meets the adaptation conditions for carrying out the adaptation operation. As a result, an optimum control factor can be set in a more stable manner.

However, when the adaptation operation is actually carried out, such as the case shown in FIGS. 3 and 4, where only the noise reduction effect is achieved without a road noise increase, rarely. This is because that, as indicated in FIGS. 15A, 15B, and 4, the location where the sensors 1*a*, 1*b*, 1*c*, and 1*d* are disposed, the location where the error microphones 2*a*, 2*b*, 2*c*, and 2*d* are disposed, or the location where speakers 3*a*, 3*b*, 3*c*, and 3*d* are disposed put limitations on the sensors, microphones, or speakers in their practical use. Hereinafter, the sensors 1*a*, 1*b*, 1*c*, and 1*d* may be collectively referred to sensor 1 in some eases. The error microphones 2*a*, 2*b*, 2*c*, and 2*d* may be collectively referred to error microphone 2 in some cases. The speakers 3*a*, 3*b*, 3*c*, and 3*d* may be collectively referred to speaker 3 in some cases.

Figure 10:
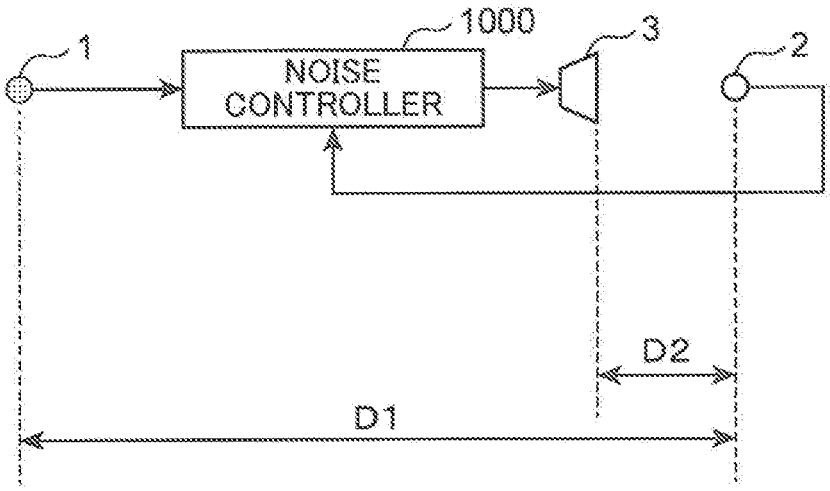
FIG. 10 is a diagram illustrating a distance from a sensor to an error microphone and a distance from a speaker to the error microphone in the noise controller.

FIG. 10 is a diagram illustrating a distance D1 from the sensor 1 to the error microphone 2 and a distance D2 from the speaker 3 to the error microphone 2 in the noise controller 1001. For example, as shown in FIG. 10, a case is assumed where a difference D1−D2 between the distance D1 from the sensor 1, which detects a noise, to the error microphone 2 and the distance D2 from the speaker 3 to the error microphone 2 cannot be secured as a distance that is sufficiently long relative to a signal processing time in the noise controller 1001. In this case, a law-of-causality condition is not met in the noise controller 1001.

When the signal processing time in the noise controller 1001 is T, to meet the law-of-causality condition, an equation 4 must be satisfied at all frequencies.

$$T \leq (D1-D2)/v \quad \text{(equation 4)}$$

In the equation 4, v denotes the sound speed.

However, as mentioned above, if the distance difference D1−D2 is not sufficiently long, the law-of-causality condition (equation 4) cannot be met when a signal with a high frequency, i.e., a long wavelength is processed. Meanwhile, considering the noise reduction effect leads to a finding that the closer the sensor 1, which detects a noise, is to the control point at which the error microphone 2 is disposed, the better the noise reduction effect is. For this reason, disposing the sensor 1, the error microphone 2, and the speaker 3 while taking the noise reduction effect into consideration results in a reduction in the distance difference D1−D2, which makes it difficult to meet the law-of-causality condition. This is a dilemma to be solved.

In addition, the characteristics of the speaker 3 also have an influence on the law-of-causality condition. Particularly, the speaker 3 shows a greater phase rotation at its low resonance frequency, thus causing a signal with a frequency close to the low resonance frequency to delay widely (group delay). For this reason, when a signal with a frequency close to the low resonance frequency is processed, meeting the law-of-causality condition becomes difficult. This means that in the noise controller 1001, to correct a group delay of signals with frequencies equal to or lower than the low resonance frequency, the distance difference D1−D2 needs to be made sufficiently long.

Figure 11:
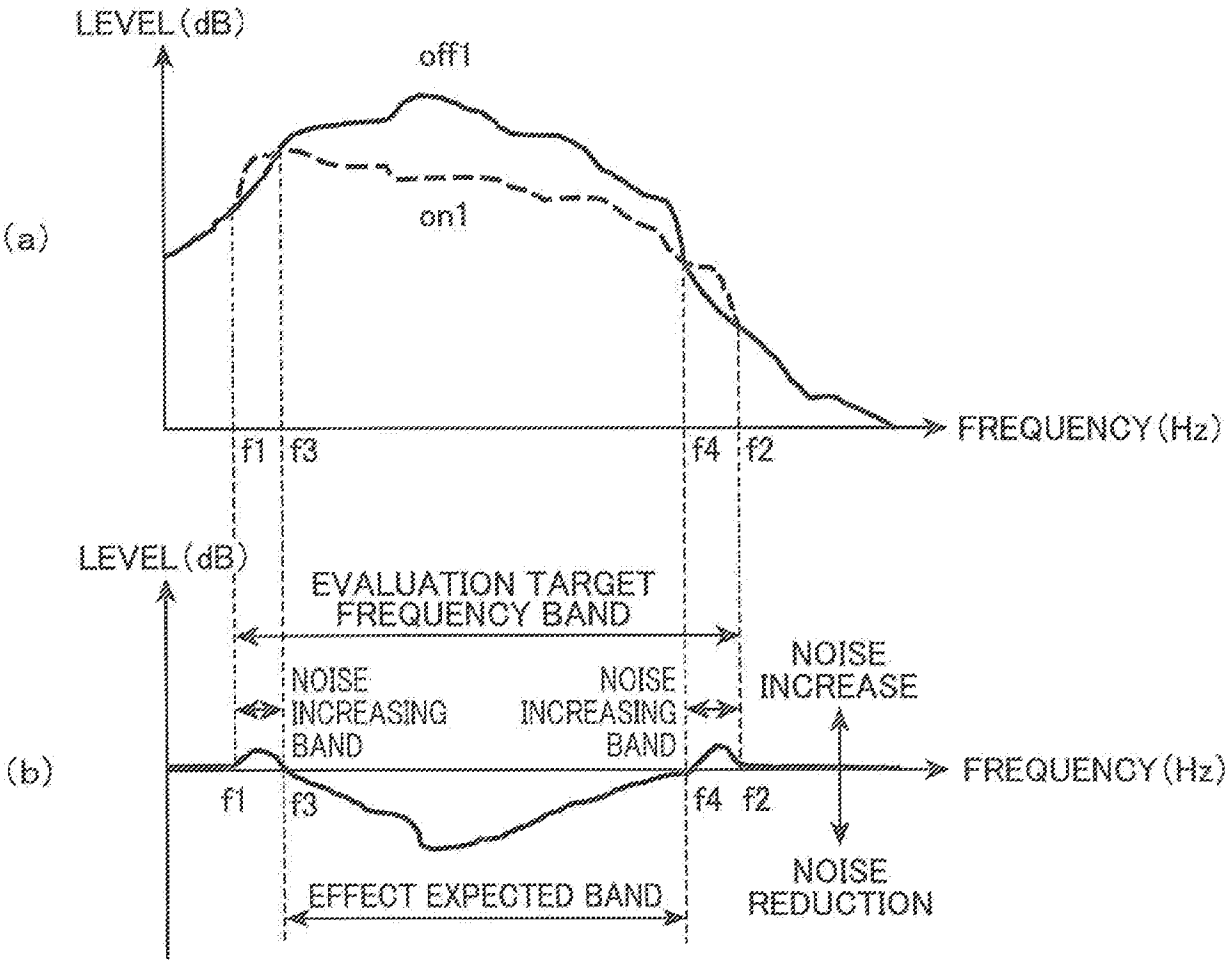
FIG. 11 is a diagram illustrating still another example of the noise reduction effect measured by the effect measuring unit.

When the law-of-causality condition is not met, a noise reduction effect achieved by the noise controller 1001 turns out to be, for example, a noise reduction effect shown in FIG. 11. FIG. 11 is a diagram illustrating still another example of the noise reduction effect measured by the effect measuring unit 50. Examples shown in sections (a) and (b) of FIG. 11 indicate that road noises with frequencies ranging from f1 to f3 increase. These road noises, in many cases, are created under the influence of the group delay occurring near the low resonance frequency of the speaker 3. Road noises with frequencies equal to or lower than f1 do not increase because the speaker 3 is incapable of reproducing a sound with a frequency equal to or lower than f1.

The sections (a) and (b) also indicate that road noises with frequencies ranging from f4 to f2 increase. This happens because a phase shift tends to occur due to high frequencies. Road noises with frequencies equal to or higher than f2 do not increase because the signal levels of the road noises are tow and the convolution process, which the control filters 20*aa*, 20*ab*, 20*ba*, and 20*bb* carry out on the road noises using control factors, further lowers the signal levels of the road noises.

As described above, most of noise control eases generally produce a noise control effect that allows a frequency band in which an expected noise control effect is achieved and a frequency band in which an undesired noise increase occurs to be present together. This leads to a conclusion that balancing a requirement for achieving an expected noise control effect and a requirement for suppressing noise increases is an issue that needs to be cleared when the control factor is actually designed.

Figure 12:
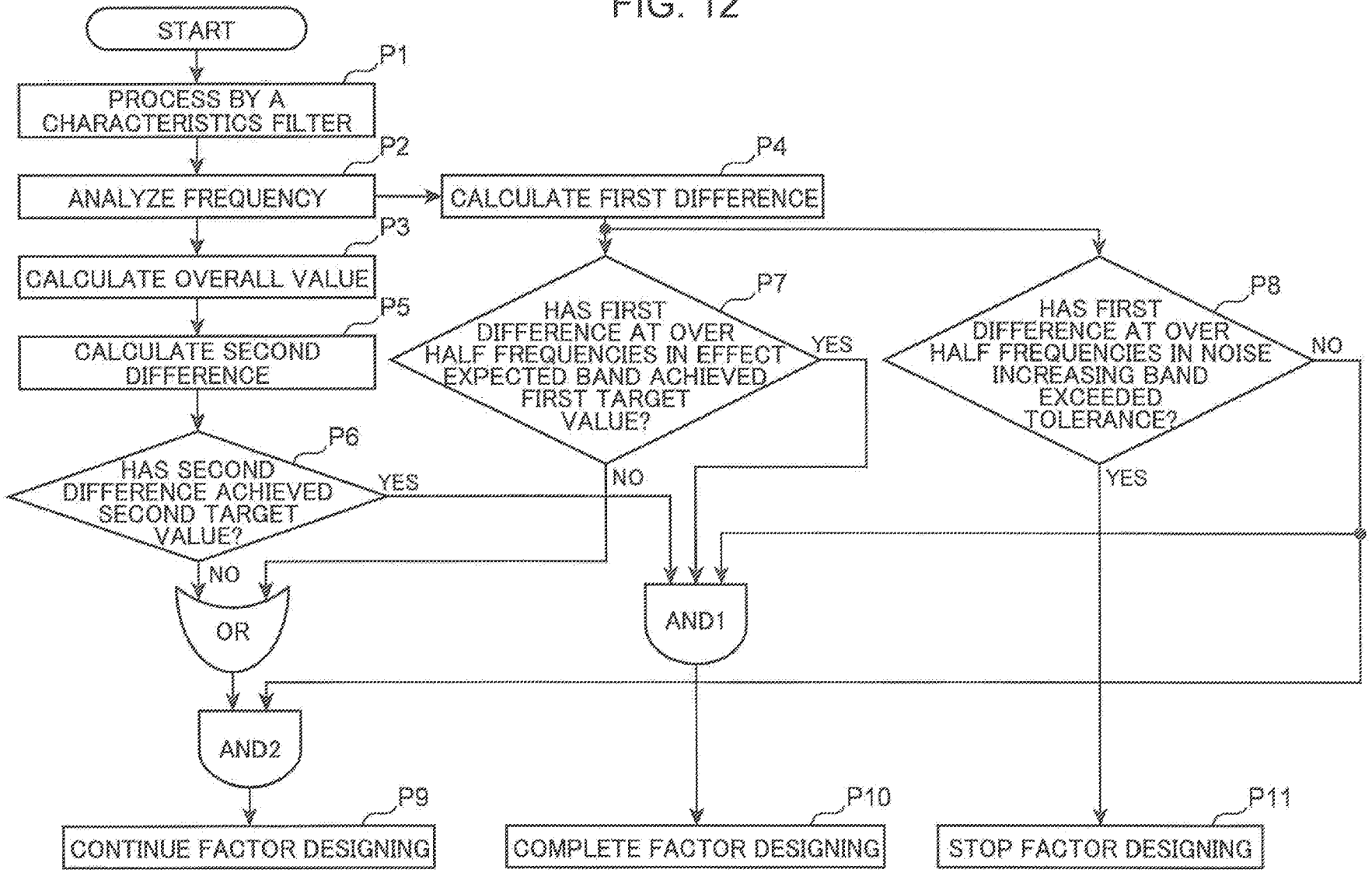
FIG. 12 is an operation flowchart showing a flow of a control factor design operation that is carried out based on a result of determination on the noise reduction effect, the determination being made by the effect measuring unit.

Determination on the noise control effect, which is a key point in control factor designing, will hereinafter be described with reference to FIG. 12. FIG. 12 is an operation flowchart showing a flow of a control factor design operation that is carried out based on a result of a determination on the noise reduction effect, the determination being made by the effect measuring unit 50. The flow shown in FIG. 12 corresponds to step S7 of FIG. 8.

A case is assumed where the effect measuring unit 50 starts the determination process of step S7, i.e., the process of determining whether a road noise reduction effect has achieved the target value at the control point, i.e., the location where the error microphone 2 is disposed. In this case, as indicated in FIG. 12, the A characteristics filters 51*a* and 51*b* (FIG. 2) perform a convolution process on the pre-noise-control signal off1 and the post-noise-control signal on1 that are input to the effect measuring unit 50, using A characteristics factors, respectively (step P1). Subsequently, the frequency analyzers 52*a* and 52*b* (FIG. 2) perform a frequency analysis on the pre-noise-control signal off1 and post-noise-control signal on1 having been subjected to the convolution process at step P1, to calculate the frequency characteristics of the pre-noise-control signal off1 and post-noise-control signal on1 (step P2).

Following step P2, for each frequency making up the frequency characteristics calculated at step P2, the frequency difference effect calculating unit 54*a* (FIG. 2) calculates a first difference, i.e., a difference between the pre-noise-control signal off1 having been subjected to the convolution process by the A characteristics filter 51*a* and the post-noise-control signal on1 having been subjected to the convolution process by the A characteristics filter 51*b* (step P4).

Meanwhile, following step P2, the overall calculating units 53*a* and 53*b* (FIG. 2) calculate a first overall value and a second overall value, respectively (step P3). It should be noted that in this operation flow, the effect measuring unit 50*a* is configured to have the band limiting units 55*a* and 55*b*, as shown in FIG. 6. In this case, at step P3, the overall calculating unit 53*a* may calculate an overall value for an extracted signal in the whole frequency band, the extracted signal being the signal extracted by the band limiting units 55*a*, as the first overall value. In the same manner, the overall calculating unit 53*b* may calculate an overall value for an extracted signal in the whole frequency band, the extracted signal being the signal extracted by the band limiting units 55*b*, as the second overall value. Subsequently, the overall value difference effect calculating unit 54*b* calculates a second difference, i.e., a difference between the first overall value and the second overall value that are calculated at step P3 (step P5).

The effect measuring unit 50 determines whether the second difference calculated at step P5 has achieved a preset second target value (step P6). It is assumed, for example, the preset second target value is −3 dBA. In this case, when the second difference is smaller than −3 dBA (second target value), the effect measuring unit 50 determines that the second difference has achieved the second target value.

The effect measuring unit 50, using the first difference at each frequency calculated at step P4, determines whether the first difference at over half of the entire frequencies included in a predetermined effect expected band (FIG. 11) in a predetermined evaluation target frequency band has achieved a preset first target value (step P7). It is assumed, for example, the preset first target value is 5 dB. In this case, when the first difference at over half of the entire frequencies included in the effect expected band (FIG. 11) is larger than 5 dB (first target value), the effect measuring unit 50 determines that the first difference has achieved the first target value.

At step P7, the effect measuring unit 50 may perform the determination process under severer conditions. For example, the effect measuring unit 50 may determine whether the first difference at a predetermined number or more of frequencies that are over half (e.g., 80% or more) of the entire frequencies included in the effect expected band has achieved the first target value.

The effect measuring unit 50, using the first difference at each frequency calculated at step P4, determines also whether the first difference at over half of the entire frequencies included in a predetermined noise increasing band (FIG. 11) in the predetermined evaluation target frequency band has exceeded a preset tolerance (step P8). It is assumed, for example, the preset tolerance is 2 dB. In this case, when the first difference at over half of the entire frequencies included in the noise increasing band (FIG. 11) is larger than 2 dB (tolerance), the effect measuring unit 50 determines that the first difference at over half of the entire frequencies has exceeded the tolerance.

At step P8, the effect measuring unit 50 may perform the determination process under severer conditions. For example, the effect measuring unit 50 may determine whether the first difference at a predetermined number or more of frequencies that are fewer than the half (e.g., 30% or less) of the entire frequencies included in the noise increasing band has exceeded the tolerance. The effect measuring unit 50 may also determine whether the first difference at one or more of the frequencies included in the noise increasing band have exceeded the tolerance, that is, may perform the determination process under further severer conditions. In another case, the effect measuring unit 50 may perform the determination process under more lenient conditions at step P8. For example, the effect measuring unit 50 may determine whether the first difference at a predetermined number or more of frequencies that are over half (e.g., 70% or more) of the entire frequencies included in the noise increasing band has exceeded the tolerance.

A case is assumed where the effect measuring unit 50 determines at step P6 that the second difference has not achieved the second target value (No at step P6) or determines at (OR) and step P7 that the first difference at over half of the entire frequencies has not achieved the first target value (No at step P7). It is then assumed in this case that the effect measuring unit 50 determines at (AND2) and step P8 that the first difference at over half of the entire frequencies has not exceeded the tolerance (NO at step P8). In this case, the effect measuring unit 50 determines that the road noise reduction effect at the control point has not achieved the target value (which corresponds to NO at step 57). In this case, the effect measuring unit 50 concludes that the control factor has not converged to an optimum value, thus continuing the adaptation operation to continue control factor designing (step P9, which corresponds to No at step S7 of FIG. 8).

A case is assumed where the effect measuring unit 50 determines at step P6 that the second difference has achieved the second target value (YES at step P6) and determines at (AND1) and step P7 that the first difference at over half of the entire frequencies has achieved the first target value (YES at step P7). It is then assumed in this case that the effect measuring unit 50 determines at (AND1) and step P8 that the first difference at over half of the entire frequencies has not exceeded the tolerance (NO at step P8), In this case, the effect measuring unit 50 determines that the road noise reduction effect at the control point has achieved the target value (which corresponds to YES at step S7). In this case, the effect measuring unit 50 concludes that the control factor has converged to the optimum value, thus completing the control factor designing normally and fixing the control factor to the optimum value (step P10, which corresponds to at step S8 of FIG. 8).

It is then assumed that the effect measuring unit 50 determines at step P8 that the first difference at over half of the entire frequencies has exceeded the tolerance (YES at step P8). This case suggests that the noise has increased to a noise level that is too high to neglect. For this reason, the effect measuring unit 50 determines that a problem with the control factor has occurred during execution of step S7, thus forcibly stopping control factor designing (step S11, which corresponds to step S9 of FIG. 8).

According to the above configuration, even if the noise increase as depicted in FIG. 11 occurs, realistic and practical control factor designing can be performed. In addition, a ratio of frequencies at which the first difference has achieved the first target value to the entire frequencies included in the effect expected band as well as a ratio of frequencies at which the first difference has reached the tolerance to the entire frequencies included in the noise increasing band is identified. This allows achieving a desirable noise reduction effect while suppressing an undesirable noise increase. Hence, control factor designing can be performed in a properly balanced manner. This provides the user with an optimum noise control effect in any case.

Now, when the noise controller 1001 is applied to the car, for example, road noise characteristics at the front seats of the car (the driver's seat and the seat next to the driver) are different from the same at the rear seats in many cases. When the determination process (step S7) of determining whether the road noise reduction effect has achieved the target value at each control point is carried out at each control point, i.e., a location where each error microphone 2 is disposed in the car, it is allowed to use the same target value. However, in place of the same target value, a separate target value, which is set separately in advance, may be used for each error microphone 2. Thus, values corresponding to each separate target value may be set separately as the first target value, the second target value, and the tolerance, respectively.

In this case, the noise reduction effect is optimized at each seat. Particularly, applications of the noise controller 1001 include a ease where the noise controller 1001 is used, for example, in a space inside an airplane and the like, in which many seats different in kind, such as seats close to windows or pathways, are present. In such a case, a separate target value suitable for each seat where the error microphone 2 is disposed may be set separately, and the first target value, the second target value, and the tolerance that correspond to the separate target value may be set separately.

For example, in FIG. 7, a noise reduction effect by the error microphone 2*a* disposed close to the top of the driver's seat is measured by the effect measuring unit 50*a*, while a noise reduction effect by the error microphone 2*b* disposed close to the top of the seat next to the driver's seat is measured by the effect measuring unit 50*b*. In this case, the target values that the effect measuring unit 50*a* and the effect measuring unit 50*b* use respectively in the determination process at step S7 may be set as a separate target value Ka and a separate target value Kb, respectively. In accordance with this setting, the first target value, the second target value, and the tolerance that the effect measuring unit 50*a* uses at step P7, step P6, and step P8 may be set respectively as a first separate target value K1*a*, a second separate target value K2*a*, and a separate tolerance K3*a* that correspond to the separate target value Ka. In the same manner, the first target value, the second target value, and the tolerance that the effect measuring unit 50*b* uses at step P7, step P6, and step P8 may be set respectively as a first separate target value K1*b*, a second separate target value K2*b*, and a separate tolerance K3*b* that correspond to the separate target value Kb. In addition to this, the effect expected band and the noise increasing hand, which are shown in FIG. 11, may also be set separately to correlate them respectively to the error microphones 2.

As indicated in FIG. 7, the noise controller 1001 as a whole controls noises simultaneously at both locations where the error microphones 2*a* and 2*b* are disposed. This means that not only the control filters 20*aa* and 20*ba* are in charge of controlling a noise at the location where the error microphone 2*a* is disposed and, likewise, not only the control filters 20*ab* and 20*bb* are in charge of controlling a noise at the location where the error microphone 2*b* is disposed.

In other words, noise control as a whole is performed to collectively optimize noises at the locations where the error microphones 2*a* and 2*b* are disposed. In the above case where target values or the like are set separately for individual error microphones 2, therefore, setting a target value widely different from other target values results in a failure in optimizing noises at the locations where the error microphones 2*a* and 2*b* are disposed. This may lead to a situation where control factor designing is not completed forever.

A case is assumed, for example, where the second separate target value K2*a* for the error microphone 2*a* is set as 3 dBA and the second separate target value K2*b* for the error microphone 2*b* is set as 4 dBA. In this case, in a configuration in which respective noise reduction effects at the error microphones 2*a* an 2*b* converge to a noise reduction value ranging from 3.0 dBA to 3.5 dBA when the second target value is not set separately for each microphone 2, setting the second separate target value K2*b* as 4 dBA obstructs control factor designing, in which ease control factor designing may not be ended properly.

To avoid such a case, in a control configuration in which a plurality of control points are collectively subjected to noise control, the control points in the control configuration unit are given priority orders to give priority orders to separate target values for the control points, and control factor designing is ended when a separate target value with a higher priority order is achieved. For example, when the second separate target value K2*a* is set as 3 dBA and is given the highest priority order, even if the second separate target value K2*b* is set as 4 dBA, control factor designing can be completed at a point of time at which a noise reduction effect at the location where the error microphone 2*a* is located reduces a noise by 3 dBA or more, regardless of a noise reduction effect at the location where the error microphone 2*b* is located. When control factor designing is completed, a control factor set at the time of completion of control factor designing is adopted as the final control factor.

Now a situation where a noise increase occurs is considered. In such a situation, at any control point, the noise reduction effect exceeding the tolerance is undesirable. For this reason, control factor designing is stopped when the noise reduction effect exceeds the tolerance at any one of the whole control points. When the adaptation operation is stopped, a control factor having produced the best noise reduction effect before the stoppage of the adaptation operation is adopted as the final control factor.

In the case of the car 100, for example, the front seats (the driver's seat and the seat next to the driver) and the rear seats of the car are all considered to be within "control configuration unit". In the case of controlling noises in a large space, such as a space inside an airplane, however, it is unnecessary to collectively consider seats separated from each other by a predetermined distance or more, as "control configuration unit" and to control noises created in the "control configuration unit". For example, "control configuration unit" may be constructed so that seats adjacent to each other are within the "control configuration unit".

The above description has clarified an overall flow of the control factor designing operation, which includes measuring the noise reduction effect and, based on the result of the measurement, determining whether control factor designing is completed, whether control factor designing needs to be continued, and whether control factor designing is to be stopped depending on the level of a noise with a specific frequency.

However, in a case where the noise controller 1001 is applied to an airplane, for example, the level and frequency characteristics of noises differ significantly between seats in front of the engine (seats for first class and business class passengers), seats by the engine (seats for some business class passengers or economy class passengers), and seats at the rear of the engine (seats for economy class passengers). Because the airplane houses 100 to 200 or more seats, optimum noise reduction effects usually vary depending on respective locations of those seats. As described above, therefore, each seat may be fitted with the error microphone 2 and the first target value, the second target value, and the tolerance may be set separately for each error microphone 2. In addition, it is preferable that an operation condition for carrying out the adaptation operation of updating the control factor be set separately for each error microphone 2.

Specifically, the operation condition is a convergence constant μ for the LMS processing units 61*aaa*, 61*aab*, 61*aba*, 61*abb*, 61*baa*, 61*bab*, 61*bba*, and 61*bbb*. Hereinafter, the LMS processing units 61*aaa*, 61*aab*, 61*aba*, 61*abb*, 61*baa*, 61*bab*, 61*bba*, and 61*bbb* will be collectively referred to as LMS processing unit 61 in some cases. As described in Japanese Unexamined Patent Application Publication No. 2004-20714 and the like, the LMS processing unit 61 updates the control factor according to the following equation 5.

$$W(n+1)=W(n)-\mu\cdot e\cdot r \qquad \text{equation 5}$$

In the equation 5, W(n) denotes the control factor of a control filter e.g., the control filter 20*aa* of FIG. 7) that is not updated yet, while W(n+1) denotes the control factor of the control filter that has been updated.

e denotes an error signal (e.g., an output signal from the error microphone 2*a* of FIG. 7).

r denotes a reference signal (e.g., an output signal from the transmission characteristics correction filter 62*aaa* of FIG. 7).

μ denotes a convergence constant (step size parameter).

· denotes multiplication.

The convergence constant μ is a value for adjusting a convergence speed or convergence rate. A larger convergence constant μ leads to a higher speed with which the control factor converges to the optimum value (hereinafter "convergence speed"). In such a case, however, a risk of the control factor's diverging in its updating operation becomes greater. Contrary to that, a smaller convergence constant μ leads to stable control factor updating. In this case, however, a low converge speed results, posing a problem that obtaining a sufficient noise reduction effect takes much time.

It is understood from the above facts that setting a proper convergence constant μ is important. However, when noise characteristics and noise levels differ between a number of seats, as in the case of a space inside an airplane, it is assumed that convergence constants μ optimum for individual seats also differ from each other. Identifying such optimum convergence constants μ in advance takes lots of trouble. It is therefore desirable that the noise controller 1001 automatically derive each of the optimum convergence constants μ. In the following description, a method of deriving an optimum convergence constant μ will be explained.

Figure 13A:
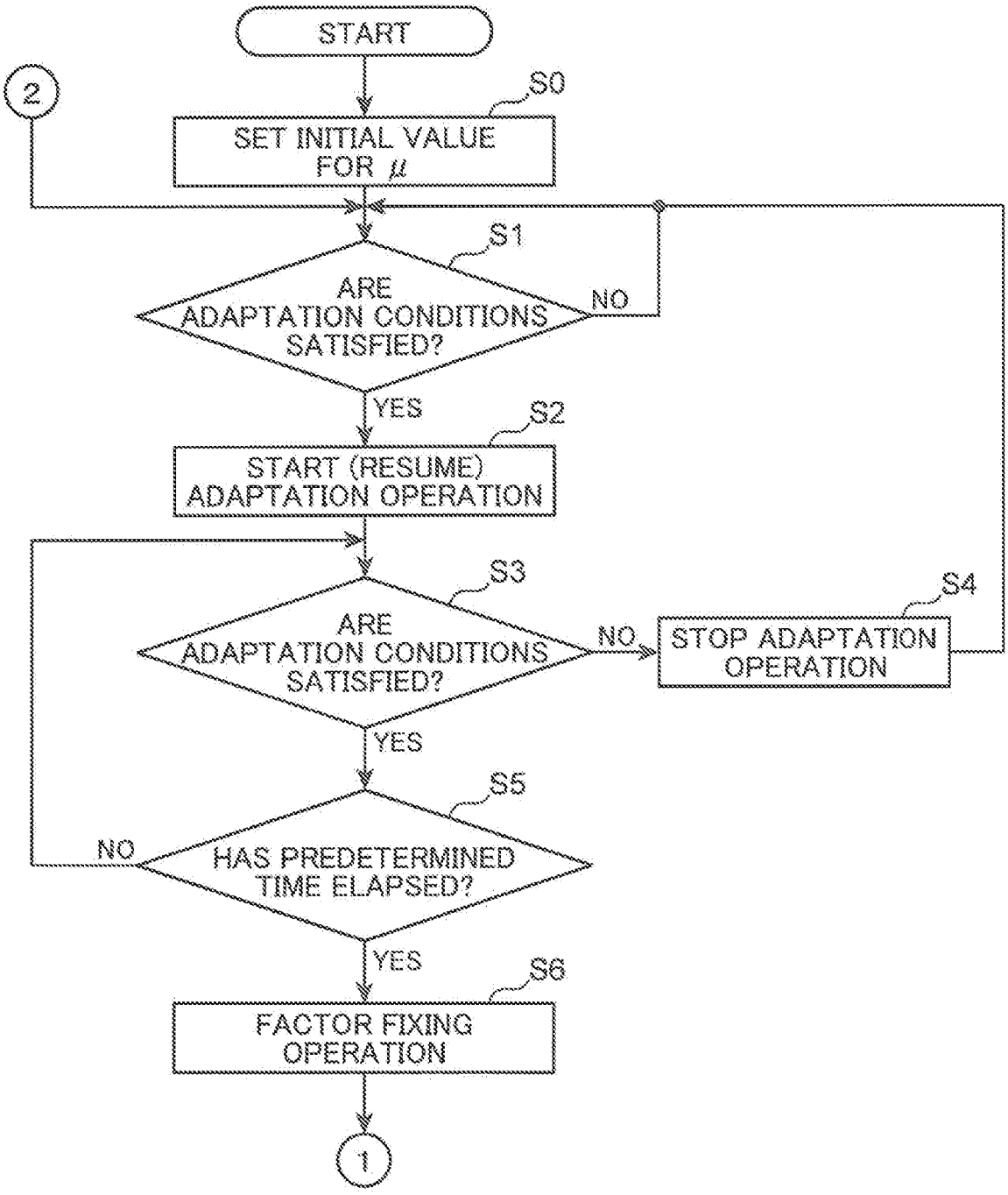
FIG. 13A is an operation flowchart showing a flow of an overall control factor design operation carried out in the entire noise controller.
Figure 13B:
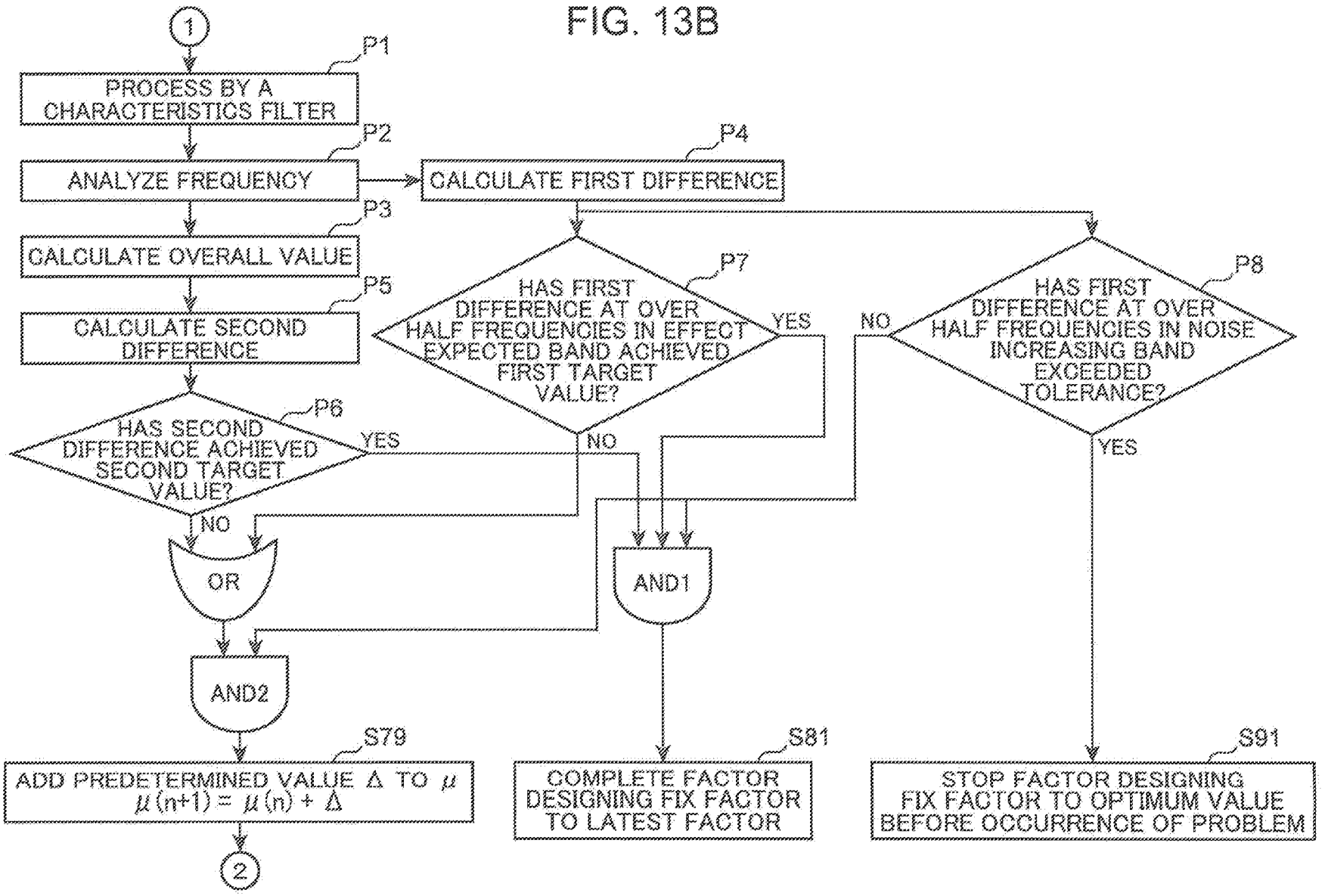
FIG. 13B is an operation flowchart showing a flow of the overall control factor design operation carried out in the entire noise controller.

FIGS. 13A and 13B are operation flowcharts each showing a flow of the overall control factor design operation carried out in the entire noise controller 1001. The operation flowcharts shown in FIGS. 13A and 13B include the same steps as included in the operation flowcharts shown in FIGS. 8 and 12. In the following description, the same steps will not be explained further and the method of deriving the optimum convergence constant μ will mainly be described.

As shown in FIG. 13A, before executing step S1, the effect measuring unit 50 sets a predetermined initial value for the convergence constant μ used by the LMS processing unit 61 (step S0). The convergence constant μ is a decimal of 0 or larger and 1 or smaller. For example, the initial value for the convergence constant μ is determined to be a value close to 0 as the stability of the adaptation operation is taken into consideration. However, the initial value for the convergence constant μ is not limited to such a value and may be determined to be 0. After the initial value for the convergence constant μ is set at step S0, processes at step S1 and other steps to follow are executed.

A case is assumed where, as shown in FIG. 13B, the effect measuring unit 50 determines at step P6 that the second difference has not achieved the second target value (NO at step P6) and determines at (OR) or step P7 that the first difference at over half of the entire frequencies has not achieved the first target value (NO at step P7). It is then assumed in this case that the effect measuring unit 50 determines at (AND2) and step P8 that the first difference at over half of the entire frequencies has not exceeded the tolerance (NO at step P8). It is further assumed that the effect measuring unit 50 thus determines that the road noise reduction effect at the control point has not achieved the target value (which corresponds to NO at step 57).

In this case, concluding that the control factor has not converged to the optimum value, the effect measuring unit 50 adds a predetermined value Δ to the convergence constant μ used for calculation of the first difference at step P4 or the convergence constant μ used for calculation of the second difference at step P5, to create a new convergence value μ+Δ. The effect measuring unit 50 then causes the factor updater 60 to resume control factor updating using the new convergence value μ+Δ. The effect measuring unit 50 thus causes the factor updater 60 to continue the adaptation operation (step S79). Afterward, step S1 and other steps to follow are executed.

Thus, after execution of step S1 to step S6, every time the control factor designing flow including step P1 to step S79 is repeated, the convergence constant μ increases by the predetermined value Δ. Because the noise reduction effect is measured during repetition of the control factor designing flow, the convergence constant μ is finally adjusted to a convergence constant μ with which the optimum noise reduction effect is obtained.

A case is assumed where the effect measuring unit 50 determines at step P6 that the second difference has achieved the second target value (YES at step P6) and determines at (AND1) and step P7 that the first difference at over half of the entire frequencies has achieved the first target value (YES at step P7). It is then assumed in this case that the effect measuring unit 50 determines at (AND1) and step P8 that the first difference at over half of the entire frequencies has not exceeded the tolerance (NO at step P8). It is further assumed that the effect measuring unit 50 thus determines that the road noise reduction effect at the control point has achieved the target value (which corresponds to YES at step S7). In this case, the effect measuring unit 50 concludes that the control factor has converged to the optimum value, thus completing the control factor designing normally and fixing the control factor to a control factor value set at the time of completing the control factor designing, i.e., the latest control factor (step S81, which corresponds to at step S8 of FIG. 8).

When determining at step P8 that the first difference at over half of the entire frequencies has exceeded the tolerance (YES at step P8), the effect measuring unit 50, concluding that the noise has increased to a noise level that is too high to neglect, determines that a problem with the control factor has occurred during execution of step S7. In this case, the effect measuring unit 50 forcibly stops control factor designing and fixes the control factor to the optimum value to which convergence of the control factor is determined at step S81 before the occurrence of the problem is determined (step P91, which corresponds to step S9 of FIG. 8).

As decried above, the noise controller 1001 repeats the adaptation operation using the convergence constant μ as the initial value, measuring the road noise reduction effect resulting from use of the fixed control factor, updating the convergence factor μ to the new convergence factor μ+Δ, and the adaptation operation using the new convergence factor μ+Δ. Through this process, even when the noise controller 1001 is applied to a large space including a number of seats, such as a space inside an airplane, the convergence factor p can be automatically adjusted to the optimum convergence factor μ. As a result, the optimum noise reduction effect can be achieved quickly at each seat.

In the above embodiment, the example of applying the noise controller 1001 to the car 100 or airplane has been described. The noise controller 1001, however, may be applied also to apparatuses and facilities other than the car 100 and airplane.

(Modifications)

The embodiments according to the present disclosure have been described above. The present disclosure is not limited to the above embodiments, and may be embodied, for example, in the form of the following modifications.

According to the noise controller 1001 of the second embodiment, step P8 and step P11 may be omitted. It is assumed in such a case that the effect measuring unit 50 determines at step P6 that the second difference has not achieved the second target value (NO at step P6) or determines at or (OR) and step P7 that the first difference at over half of the entire frequencies has not achieved the first target value (NO at step P7). In this case, the effect measuring unit 50 may determine immediately that the road noise reduction effect at the control point has not achieved the target value (which corresponds to NO at step S7). A case is assumed where the effect measuring unit 50 determines at step P6 that the second difference has achieved the second target value (YES at step P6) and determines at (AND1) and step P7 that the first difference at over half of the entire frequencies has achieved the first target value (YES at step P7). In this case, the effect measuring unit 50 may determine immediately that the road noise reduction effect at the control point has achieved the target value (which corresponds to YES at step S7).

According to the noise controller 1001 of the second embodiment, step P7 may be omitted. In this case, when determining at step P6 that the second difference has not achieved the second target value (NO at step P6), the effect measuring unit 50 may determine immediately that the road noise reduction effect at the control point has not achieved the target value (NO at step S7). When determining at step P6 that the second difference has achieved the second target value (YES at step P6), the effect measuring unit 50 may determine immediately that the road noise reduction effect at the control point has achieved the target value (YES at step S7).

According to the noise controller 1001 of the second embodiment, step P6 may be omitted. In this case, when determining at step P7 that the first difference at over half of the entire frequencies has not achieved the first target value (NO at step P7), the effect measuring unit 50 may determine that the road noise reduction effect at the control point has not achieved the target value (NO at step S7). When determining at step P7 that the first difference at over half of the entire frequencies has achieved the first target value (YES at step P7), the effect measuring unit 50 may determine that the road noise reduction effect at the control point has achieved the target value (YES at step S7).

The above sensor 1*a*, 1*b*, 1*c*, 1*d* may be a microphone that detects a noise created at the location where it is disposed and that outputs a noise signal indicative of the detected noise.

This application is based on Japanese Patent application No. 2018-201803 filed in Japan Patent Office on Oct. 26, 2018 and Japanese Patent application No. 2019-132433 filed in Japan Patent Office on Jul. 18, 2019, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A noise controller, comprising:

a noise detector that detects a noise generated by a noise source;

a control filter that performs signal processing on a noise signal indicative of the noise detected by the noise detector, using a predetermined control factor;

a speaker that reproduces an output signal from the control filter, as a control sound;

an error microphone that is disposed at a control point where interference between the noise propagated from the noise source and the control sound reproduced by the speaker occurs, and detects a residual noise that is left at the control point as a result of the interference;

a transmission characteristics correction filter that performs signal processing on the noise signal, using characteristics of sound transmission from the speaker to the error microphone;

a factor updater that updates the control factor to minimize an error signal, using the error signal indicative of the residual noise detected by the error microphone and an output signal from the transmission characteristics correction filter;

a correction filter that performs signal processing on an output signal from the control filter, using the characteristics of sound transmission from the speaker to the error microphone; and a subtractor that subtracts, from the error signal, an output signal from the correction filter, wherein the error signal is processed as a control-on signal representing a noise having been subjected to control by the interference, and an output signal from the subtractor is processed as a control-off signal representing a noise not yet subjected to control by the interference, the control-on signal and the control-off signal being simultaneously calculated while the speaker reproduces the output signal from the control filter, as the control sound, and the noise controller further includes an effect measuring unit that measures a noise reduction effect at the control point based on a difference between the control-off signal and the control-on signal.

2. The noise controller according to claim 1, further comprising:

an adaptation enabling state determining unit that determines whether or not to cause the factor updater to update the control factor.

3. The noise controller according to claim 1, wherein the factor updater updates the control factor, using a predetermined convergence constant, the effect measuring unit measures a difference between the control-off signal and the control-on signal as the noise reduction effect, and performs a determination process of determining whether the noise reduction effect has achieved a predetermined target value, when determining in the determination process that the noise reduction effect has achieved the predetermined target value, the effect measuring unit concludes that the control factor has converged to an optimum value, and stops the factor updater from updating the control factor to fix the control factor to the optimum value, and when determining that the noise reduction effect has not achieved the predetermined target value, the effect measuring unit concludes that the control factor has not converged to the optimum value, and creates a new convergence constant by adding a predetermined value to the convergence constant used by the factor updater at time of measurement of the noise reduction effect and causes the factor updater to resume updating of the control factor using the new convergence constant.

4. The noise controller according to claim 3, wherein the effect measuring unit performs signal processing on the control-off signal and the control-on signal, using an A characteristics factor indicative of A characteristics imitating human auditory characteristics, and measures a difference between the control-off signal having been subjected to the signal processing and the control-on signal having been subjected to the signal processing, as the noise reduction effect.

5. The noise controller according to claim 1, wherein the effect measuring unit includes a frequency analyzer that calculates frequency characteristics of the control-off signal and the control-on signal, and a frequency difference effect calculating unit that, for each frequency making up the frequency characteristics, calculates a first difference representing a difference between the control-off signal and the control-on signal, as an index for the noise reduction effect.

6. The noise controller according to claim 1, wherein the effect measuring unit includes a frequency analyzer that calculates frequency characteristics of the control-off signal and the control-on signal, an overall calculating unit that calculates an overall value for the control-off signal and an overall value for the control-on signal in whole frequency bands, using the frequency characteristics, and an overall value difference effect calculating unit that calculates a second difference representing a difference between the overall value for the control-off signal and the overall value for the control-on signal, as an index for the noise reduction effect.

7. The noise controller according to claim 1, wherein the effect measuring unit includes a frequency analyzer that calculates frequency characteristics of the control-off signal and the control-on signal, a frequency difference effect calculating unit that, for each frequency making up the frequency characteristics, calculates a first difference representing a difference between the control-off signal and the control-on signal, as an index for the noise reduction effect, an overall calculating unit that calculates an overall value for the control-off signal and an overall value for the control-on signal in whole frequency bands, using the frequency characteristics, and an overall value difference effect calculating unit that calculates a second difference representing a difference between the overall value for the control-off signal and the overall value for the control-on signal, as an index for the noise reduction effect.

8. The noise controller according to claim 6, wherein the effect measuring unit further includes a band limiting unit that extracts signals with frequencies within a predetermined evaluation target frequency band from the control-off signal and from the control-on signal, using the frequency characteristics, the overall calculating unit calculates an overall value for a signal extracted from the control-off signal by the band limiting unit and an overall value for a signal extracted from the control-on signal by the band limiting unit, in whole frequency bands, and the overall value difference effect calculating unit calculates a difference between the overall value for the signal extracted from the control-off signal by the band limiting unit and the overall value for the signal extracted from the control-on signal by the band limiting unit, as the second difference.

9. The noise controller according to claim 5, wherein the factor updater updates the control factor using a predetermined convergence constant, the effect measuring unit performs a determination process of determining whether the noise reduction effect has achieved a predetermined target value, when, in the determination process, the first difference at over half of entire frequencies included in a predetermined evaluation target frequency band has achieved a predetermined first target value corresponding to the target value, the first difference being calculated by the frequency difference effect calculating unit, the effect measuring unit determines that the noise reduction effect has achieved the target value to conclude that the control factor has converged to an optimum value, and stops the factor updater from updating the control factor to fix the control factor to the optimum value, and when the first difference at over half of the entire frequencies included in the evaluation target frequency band has not achieved the first target value, the first difference being calculated by the frequency difference effect calculating unit, the effect measuring unit determines that the noise reduction effect has not achieved the target value to conclude that the control factor has not converged to the optimum value, and creates a new convergence constant by adding a predetermined value to the convergence constant used by the factor updater at time of calculation of the first difference and causes the factor updater to resume updating of the control factor using the new convergence constant.

10. The noise controller according to claim 6, wherein the factor updater updates the control factor using a predetermined convergence constant, the effect measuring unit performs a determination process of determining whether the noise reduction effect has achieved a predetermined target value, when, in the determination process, the second difference has achieved a predetermined second target value corresponding to the target value, the effect measuring unit determines that the noise reduction effect has achieved the target value to conclude that the control factor has converged to an optimum value, and stops the factor updater from updating the control factor to fix the control factor to the optimum value, and when the second difference has not achieved the second target value, the effect measuring unit determines that the noise reduction effect has not achieved the target value to conclude that the control factor has not converged to the optimum value, and creates a new convergence constant by adding a predetermined value to the convergence constant used by the factor updater at time of calculation of the second difference and causes the factor updater to resume updating of the control factor using the new convergence constant.

11. The noise controller according to claim 7, wherein the factor updater updates the control factor using a predetermined convergence constant, the effect measuring unit performs a determination process of determining whether the noise reduction effect has achieved a predetermined target value, when, in the determination process, the first difference at over half of entire frequencies included in a predetermined evaluation target frequency band has achieved a predetermined first target value corresponding to the target value, the first difference being calculated by the frequency difference effect calculating unit, and the second difference has achieved a predetermined second target value corresponding to the target value, the effect measuring unit determines that the noise reduction effect has achieved the target value to conclude that the control factor has converged to an optimum value, and stops the factor updater from updating the control factor to fix the control factor to the optimum value, when the first difference at over half of the entire frequencies included in the evaluation target frequency band has not achieved the first target value, the first difference being calculated by the frequency difference effect calculating unit, the effect measuring unit determines that the noise reduction effect has not achieved the target value to conclude that the control factor has not converged to the optimum value, and creates a new convergence constant by adding a predetermined value to the convergence constant used by the factor updater at time of calculation of the first difference and causes the factor updater to resume updating of the control factor using the new convergence constant, and when the second difference has not achieved the second target value, the effect measuring unit determines that the noise reduction effect has not achieved the target value to conclude that the control factor has not converged to the optimum value, and creates a new convergence constant by adding a predetermined value to the convergence constant used by the factor updater at time of calculation of the second difference and causes the factor updater to resume updating of the control factor using the new convergence constant.

12. The noise controller according to claim 9, wherein when, in the determination process, the first difference at a predetermined number or more of frequencies out of frequencies in a predetermined noise increasing band included in the evaluation target frequency band, the first difference being calculated by the frequency difference effect calculating unit, exceeds a predetermined tolerance set in accordance with the target value, the effect measuring unit concludes that a problem with the control factor has occurred and stops the factor updater from updating the control factor.

13. The noise controller according to claim 12, wherein the predetermined number is 1.

14. The noise controller according to claim 3, comprising:

a plurality of the error microphones, wherein the effect measuring unit performs the determination process on each of the plurality of error microphones, with a location where each of the plurality of error microphones is disposed being defined as the control point and a separate target value set in advance for each of the plurality of error microphones being defined as the target value.

15. The noise controller according to claim 14, wherein the separate target values are given priority orders, and when determining in the determination process that the noise reduction effect has achieved the target value, the determination process using the separate target value given a highest priority order, as the target value, the effect measuring unit determines that the noise reduction effect has achieved the target value at every control point at which the determination process is performed.

16. The noise controller according to claim 2, wherein when a value given by averaging instantaneous value levels of the error signal in a predetermined period is within a predetermined threshold range, the adaption enabling state determining unit determines to cause the factor updater to update the control factor.

17. A noise control method performed by a computer of a noise controller, the noise control method comprising:

detecting a noise generated by a noise source, using a sensor;

performing first signal processing on a noise signal indicative of the noise detected by the sensor, using a predetermined control factor;

causing a speaker to reproduce a signal resulting from the first signal processing, as a control sound;

detecting a residual noise that is left at a control point as a result of interference, using an error microphone disposed at the control point where the interference between the noise propagated from the noise source and the control sound reproduced by the speaker occurs;

performing second signal processing on the noise signal, using characteristics of sound transmission from the speaker to the error microphone;

updating the control factor to minimize an error signal, using the error signal indicative of the residual noise detected by the error microphone and a signal resulting from the second signal processing;

performing third signal processing on a signal resulting from the first signal processing, using the characteristics of sound transmission from the speaker to the error microphone;

subtracting, from the error signal, a signal resulting from the third signal processing;

processing the error signal as a control-on signal representing a noise having been subjected to control by the interference, processing a signal given by the subtraction as a control-off signal representing a noise not yet subjected to control by the interference, and calculating the control-on signal and the control-off signal simultaneously while causing the speaker to reproduce the output signal from the control filter, as the control sound; and measuring a noise reduction effect at the control point based on a difference between the control-off signal and the control-on signal.

18. A non-transitory computer-readable recording medium, storing therein a program that causes a computer to execute the noise control method according to claim 17.

19. A noise controller, comprising:

a noise detector that detects a noise generated by a noise source;

a control filter that performs signal processing on a noise signal indicative of the noise detected by the noise detector, using a predetermined control factor;

a speaker that reproduces an output signal from the control filter, as a control sound;

an error microphone that is disposed at a control point where interference between the noise propagated from the noise source and the control sound reproduced by the speaker occurs, and detects a residual noise that is left at the control point as a result of the interference;

a correction filter that performs signal processing on an output signal from the control filter, using characteristics of sound transmission from the speaker to the error microphone; and a subtractor that subtracts, from the error signal, an output signal from the correction filter, wherein the error signal is processed as a control-on signal representing a noise having been subjected to control by the interference, and an output signal from the subtractor is processed as a control-off signal representing a noise not yet subjected to control by the interference, the control-on signal and the control-off signal being simultaneously calculated while the speaker reproduces the output signal from the control filter, as the control sound, and the noise controller further including an effect measuring unit that measures a noise reduction effect at the control point based on a difference between the control-off signal and the control-on signal.

* * * * *